US012075865B2

(12) United States Patent
Jefferis

(10) Patent No.: US 12,075,865 B2
(45) Date of Patent: Sep. 3, 2024

(54) SURGICAL GARMENT AND METHODS OF ADJUSTING THE SAME

(71) Applicant: Stryker Corporation, Kalamazoo, MI (US)

(72) Inventor: Ryan A. Jefferis, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 870 days.

(21) Appl. No.: 17/057,421

(22) PCT Filed: May 22, 2019

(86) PCT No.: PCT/US2019/033584
§ 371 (c)(1),
(2) Date: Nov. 20, 2020

(87) PCT Pub. No.: WO2019/226810
PCT Pub. Date: Nov. 28, 2019

(65) Prior Publication Data

US 2021/0204621 A1 Jul. 8, 2021

Related U.S. Application Data

(60) Provisional application No. 62/674,876, filed on May 22, 2018.

(51) Int. Cl.
*A41D 13/12* (2006.01)
*A41F 9/02* (2006.01)

(52) U.S. Cl.
CPC ..... *A41D 13/1209* (2013.01); *A41F 9/025* (2013.01); *A44D 2203/00* (2013.01)

(58) Field of Classification Search
CPC ..... A41F 9/025; A41D 13/1209; A41D 13/1245
See application file for complete search history.

(56) References Cited

U.S. PATENT DOCUMENTS 3,594,818 A 7/1971 Planner
3,935,596 A 2/1976 Allen, Jr. et al.
4,255,818 A 3/1981 Crowley et al.
4,326,300 A * 4/1982 Bolton ..... A41D 13/1209 2/311

(Continued)

FOREIGN PATENT DOCUMENTS

CN 201602165 U 10/2010
CN 206294931 U 7/2017

(Continued)

OTHER PUBLICATIONS

Machine-assisted English translation for CN 201602165 U extracted from espacenet.com database on May 18, 2022, 4 pages.

(Continued)

*Primary Examiner* — Katherine M Moran
(74) *Attorney, Agent, or Firm* — Howard & Howard Attorneys PLLC

(57) ABSTRACT

A self-adjustable surgical garment includes a front defining a centerline, a back, and two sides connecting the front and the back. The self-adjustable surgical garment also includes a strap having a first end portion, a second end portion opposite the first end portion, and a fastening portion. The strap is attached at the first end portion to the back. Additionally, the fastening portion is removably coupled to a portion of the garment such that the second end portion is in a sterile zone of a wearer. The region corresponding to a sterile zone of the wearer being at least partially defined as a region within ninety degrees in either direction of the centerline.

20 Claims, 26 Drawing Sheets

(56) References Cited

U.S. PATENT DOCUMENTS

| | | | | |
|---|---|---|---|---|
| 4,384,370 | A * | 5/1983 | Singer | A41D 13/1209 2/114 |
| 4,558,468 | A | 12/1985 | Landry et al. | |
| 4,674,132 | A * | 6/1987 | Stein | A41D 13/1209 2/114 |
| 4,982,448 | A | 1/1991 | Kogut | |
| 5,140,708 | A * | 8/1992 | Burns | A41D 13/1209 2/46 |
| 5,386,616 | A | 2/1995 | Norvell | |
| 7,954,209 | B2 | 6/2011 | Chen | |
| 8,220,074 | B2 * | 7/2012 | Sutker | A41D 13/0058 2/69 |
| 11,602,181 | B2 * | 3/2023 | Palomo | A41D 13/1245 |
| 2005/0044608 | A1 | 3/2005 | Ambrose et al. | |
| 2008/0155728 | A1 * | 7/2008 | Hafer | A41D 27/245 2/69 |
| 2009/0217440 | A1 | 9/2009 | Sutker | |
| 2013/0318682 | A1 | 12/2013 | Graneto, III | |
| 2013/0318693 | A1 | 12/2013 | McBride et al. | |
| 2015/0150316 | A1 | 6/2015 | Champagne et al. | |
| 2016/0066633 | A1 | 3/2016 | Greenacre | |
| 2022/0071329 | A1 * | 3/2022 | Foster | A41D 13/1245 |

FOREIGN PATENT DOCUMENTS

| | | | |
|---|---|---|---|
| CN | 207355528 | U | 5/2018 |
| FR | 2290168 | A1 | 6/1976 |

OTHER PUBLICATIONS

English language abstract and machine-assisted English translation for CN 206294931 U extracted from espacenet.com database on May 18, 2022, 7 pages.

English language abstract and machine-assisted English translation for CN 207355528 U extracted from espacenet.com database on May 18, 2022, 8 pages.

English language abstract for FR 2 290 168 A1 extracted from espacenet.com database on May 18, 2022, 2 pages.

International Search Report for Application No. PCT/US2019/033584 dated Oct. 9, 2019, 4 pages.

Stryker, "Steri-Shield Personal Protection System Flyte Toga, Zippered Instructions for Use", DSGN-fm-50366, Rev. A, Apr. 28, 2016, 117 pages.

Velcro Industries, "High Technology Hook Brochure", 2011, 2 pages.

* cited by examiner

FIG. 9
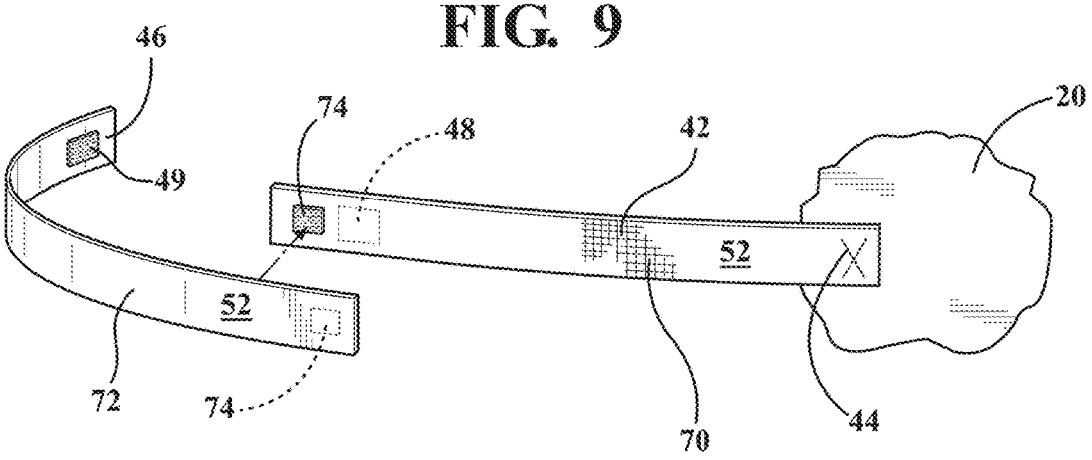
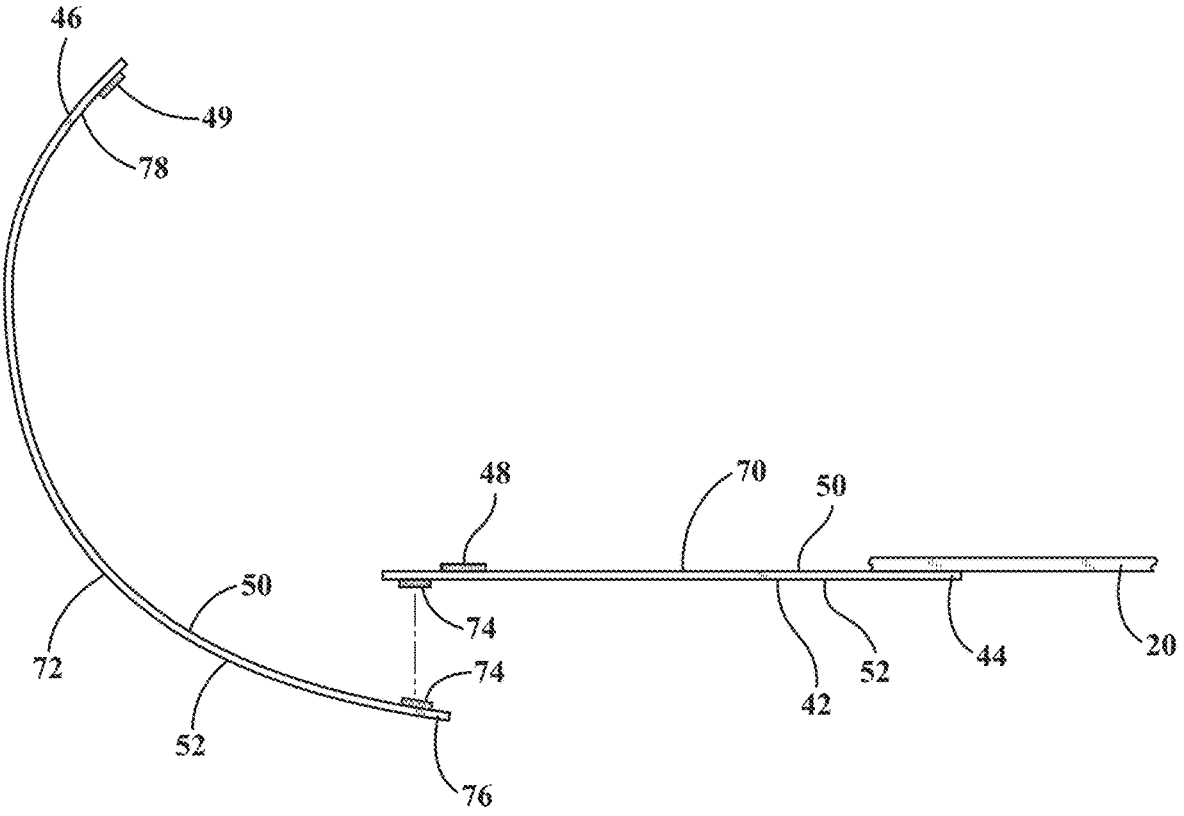
FIG. 10

SURGICAL GARMENT AND METHODS OF ADJUSTING THE SAME

CROSS-REFERENCE TO RELATED APPLICATIONS

The present application is the National Stage of International Patent Application No. PCT/US2019/033584 filed on May 22, 2019, which claims priority to and benefit of U.S. Provisional Patent Application No. 62/674,876, filed on May 22, 2018, the entire contents of which is hereby incorporated by reference in its entirety.

TECHNICAL FIELD

The examples disclosed herein relate, generally, to wearable surgical garments and, more specifically, to a self-adjustable surgical garment and methods of adjusting the same.

BACKGROUND

In surgical procedures, it is common practice for every person in the operating room to wear a surgical garment for sterility purposes. Such surgical garments include overhead gowns, tie-close gowns, zippered gowns, and the like.

In a typical surgical procedure, a first person into the operating room dons and adjusts their surgical garment and then assists others in adjusting their surgical garments. This must be done without their hands leaving a region corresponding to a sterile zone. Various techniques have been used to avoid compromising the sterility of the surgical garment and the wearer such as the use of tie cards and/or a partner technique. In one example, the first person into the operating room would wait for a second person to help adjust the surgical garment. The second person would typically stand behind the first wearer and adjust the straps, with or without the use of a tie-card in order to secure the surgical garment of the first wearer. The first wearer would then help the second wearer adjust their surgical garment. This technique is repeated until all persons in the operating room have donned and adjusted their surgical garments.

To address these and other concerns, examples of the present disclosure provide surgical garments and methods to allow self-adjusting of the surgical garments without the wearer's hands exiting the region corresponding to the sterile zone.

Additionally, in another example, the surgical garment may include a zipper. However, the inclusion of a zipper may cause the surgical garment to fail microbial barrier testing as the zipper may allow fluid therethrough. To address this and other concerns, examples of the present disclosure provide surgical garments which have a zipper or other closing mechanism while still providing the waterproof barrier necessary to pass microbial barrier testing of the surgical garment.

SUMMARY

A self-adjustable surgical garment includes a front defining a centerline, a back, and two sides connecting the front and the back. The self-adjustable surgical garment also includes a strap having a first end portion, a second end portion opposite the first end portion, and a fastening portion. The strap is attached at the first end portion to the back. Additionally, the fastening portion is removably coupled to a portion of the garment such that the second end portion is in a region corresponding to a sterile zone of a wearer. The region corresponding to the sterile zone of the wearer being at least partially defined as a region within ninety degrees in either direction of the centerline.

A method of securing a self-adjustable surgical garment is disclosed herein. The self-adjustable surgical garment includes a front, a back, two sides connecting the front and the back, a first and second strap each having a first end portion, a second end portion opposite the first end portion, and a fastening portion. The first and second strap are each attached at the first end portion to the back. The surgical garment also includes a third strap removably coupled to the first strap and the second strap. The method includes donning the self-adjustable surgical garment onto a wearer such that the first and second straps are at least partially disposed outside a region corresponding to a sterile zone of the wearer and the third strap is at least partially disposed within the region corresponding to the sterile zone of the wearer. The method also includes the step of moving the first and second straps from a starting position where the fastening portion is coupled the back or the sides of the garment to a tightened position where the fastening portion is coupled to the front of the garment without hands of the wearer exiting the region corresponding to a sterile zone of the wearer.

The surgical garment and method disclosed herein allow a wearer to self-adjust and secure straps on the surgical garment without removing their hands from the region corresponding to the sterile zone of the wearer. This configuration helps prevent contamination from regions outside the region corresponding to the sterile zone of the wearer from being spread to other locations in the operating room.

A surgical garment includes a front, a back defining a rear mid-line, and two sides connecting the front and the back. The front, the back, and the two sides form a microbial barrier to a wearer. Additionally, the surgical garment includes a closing mechanism disposed along the rear mid-line and a flap extending over the closing mechanism. Moreover, the surgical garment includes at least one magnetic element adjacent the rear mid-line and configured to secure the flap over the closing mechanism to provide a microbial barrier to the closing mechanism.

A method of securing a surgical garment is also disclosed herein The surgical garment includes a front; a back defining a rear mid-line; two sides connecting said front and said back, a closing mechanism disposed along said rear mid-line; a flap extending over said closing mechanism; and at least one magnetic element adjacent said rear mid-line. The method includes donning the surgical garment onto a wearer, actuating the closing mechanism such that the closing mechanism is in a closed position; and securing the flap over the closing mechanism using the at least one magnetic element to provide a microbial barrier to the closing mechanism.

BRIEF DESCRIPTION OF THE DRAWINGS

Advantages of the present invention will be readily appreciated as the same becomes better understood by reference to the following detailed description when considered in connection with the accompanying drawings wherein:

FIG. 9 is a rear partially-exploded perspective view of the surgical garment and the strap of the surgical garment of FIG. 1, with the surgical garment cut-away for clarity.

FIG. 10 is an exploded top-side plan view of the surgical garment and the strap of the surgical garment of FIG. 1, with the surgical garment cut-away for clarity.

DETAILED DESCRIPTION

Figure 1:
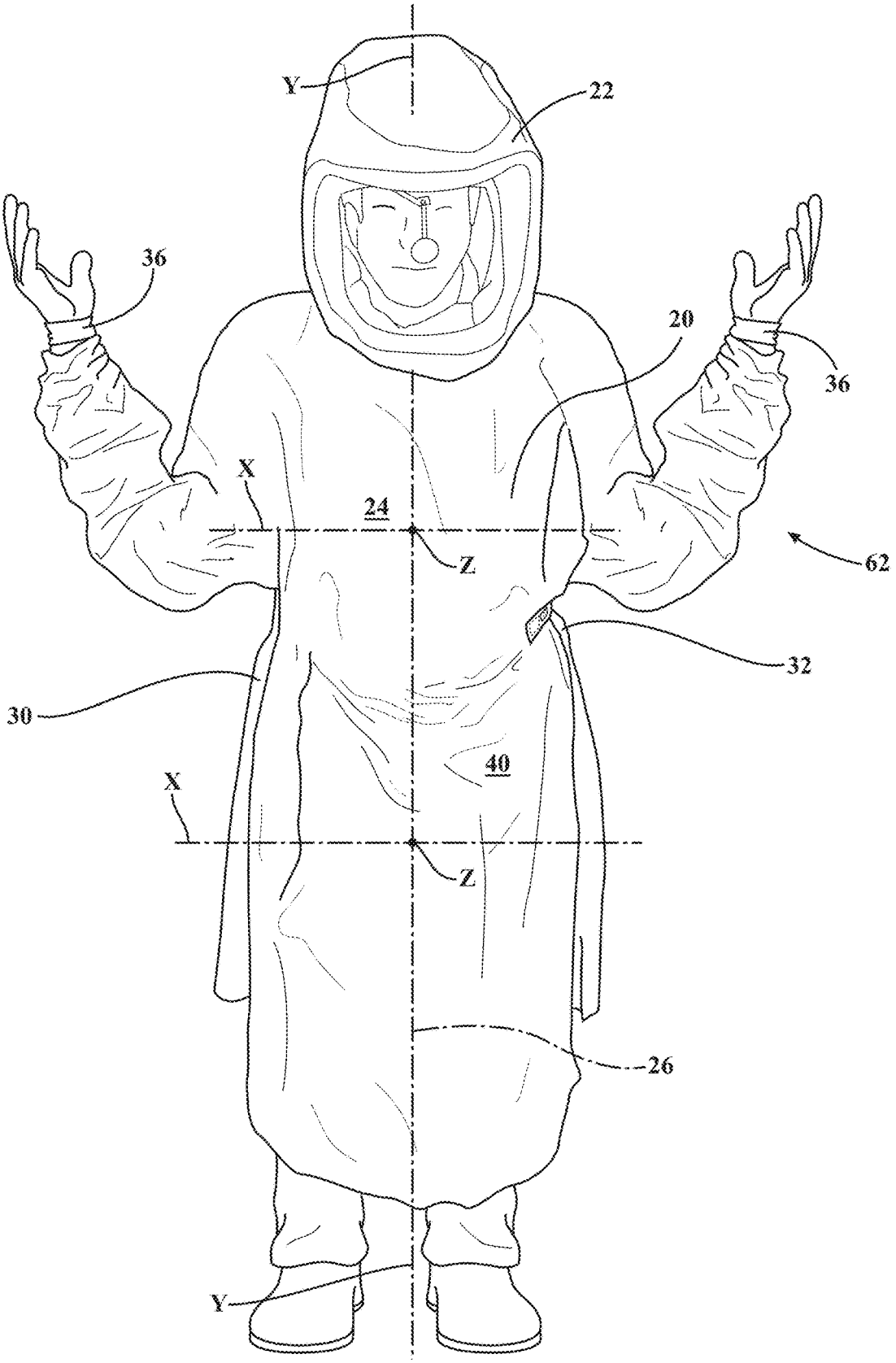
FIG. 1 is a front perspective view of a surgical garment donned by a wearer and having straps in a tightened position.

With reference to the drawings, where like numerals are used to designate like structure throughout the several views, a surgical garment is generally indicated at 20 in FIGS. 1-8. The surgical garment 20 is self-adjustable and configured to provide a barrier between a wearer and the outside environment. In one example, the surgical garment 20 is a toga configured to cover from a wearer's shoulders down past the knees of the wearer. The toga may be an over-head toga such that the toga must be put over the wearer's head in order to don the toga. Additionally, it is contemplated that the toga may not require an over-head donning such that the toga may include a zipper or a set of ties in order to close the toga during use. Moreover, the toga may be paired with a surgical hood 22 to provide coverage of the head and neck areas. The surgical hood or 22 may be a separate hood 22 such as the one described in US Patent Application No. 2016/066633, which is hereby incorporated by reference herein. Additionally, it is contemplated that the surgical hood 22 may be integral with or otherwise attached to the toga. In the example including the hood or helmet 22, the term surgical garment 20 may refer to the toga itself or the toga along with the surgical hood or helmet 22.

According to one aspect, the surgical garment 20 may comprise a tightly woven material. The tightly woven material may be a polyester, cotton, or a polyester-cotton blend. Additionally, it is contemplated that the surgical garment 20 may comprise non-woven material such as fibers or filaments of paper, cotton, polyester, and the like. Moreover, the surgical garment 20 may have a coating or other re-enforcement to provide an additional barrier and/or repel fluids. Typically, the surgical garment 20 is disposable such that the garment is discarded as waste after a single use. However, it is also contemplated that the surgical garment 20 could be a re-usable surgical garment 20 such that the garment is sterilized and re-used for multiple uses.

Referring still to FIGS. 1-8, the surgical garment 20 comprises a front 24 defining a centerline 26, a back 28, and two sides 30, 32 which connect the front 24 and the back 28. In the example illustrated in FIG. 2, when donned by the wearer, the front 24 of the surgical garment 20 covers the chest and stomach area of the wearer while the back 28 of the surgical garment 20 covers the back and rear end of the wearer. The first side 30 and the second side 32 each couple the front 24 of the surgical garment 20 to the back 28 of the surgical garment 20 to provide a 360 degree barrier to the wearer.

Figure 8:
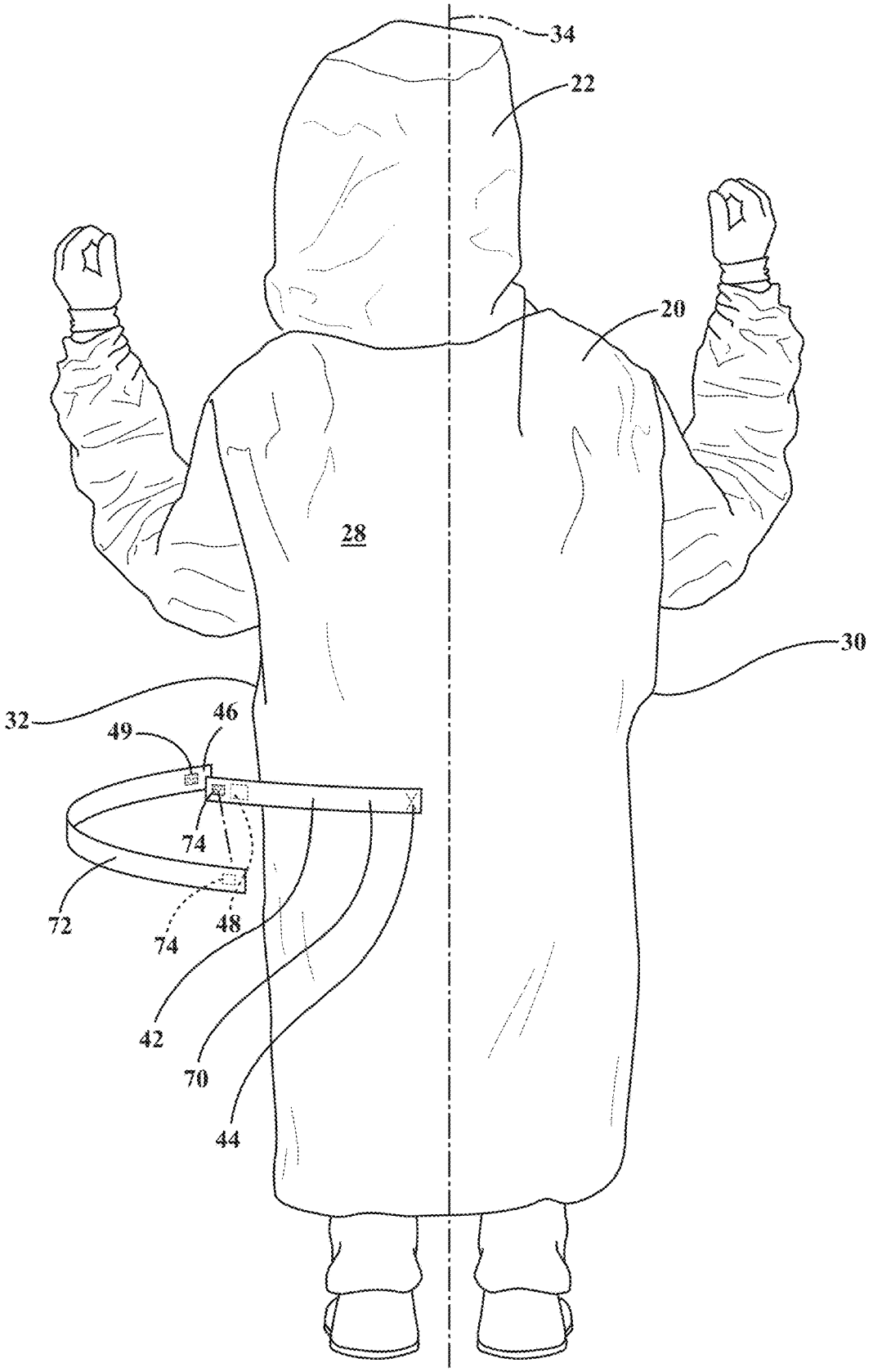
FIG. 8 is rear partially exploded perspective view of the surgical garment of FIG. 1, with the first segment spaced apart from the second segment.
Figure 11:
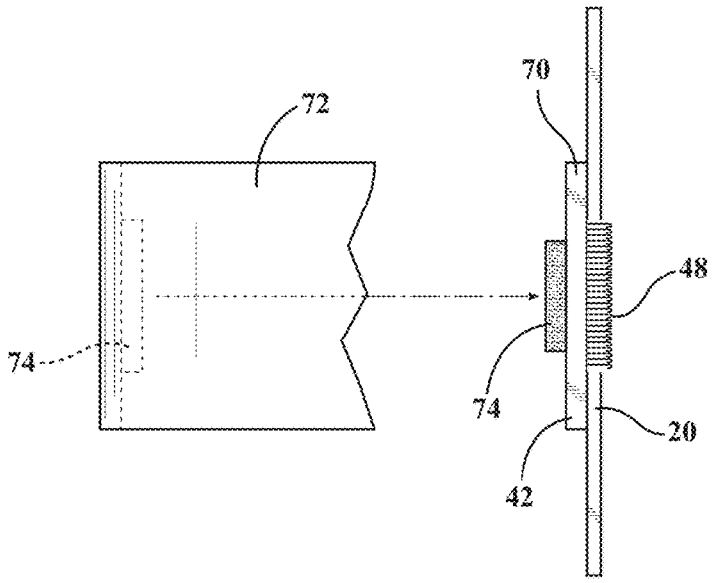
FIG. 11 is an exploded partial side plan view of the surgical garment and the strap of the surgical garment of FIG. 1, with the surgical garment cut-away for clarity.
Figure 12:
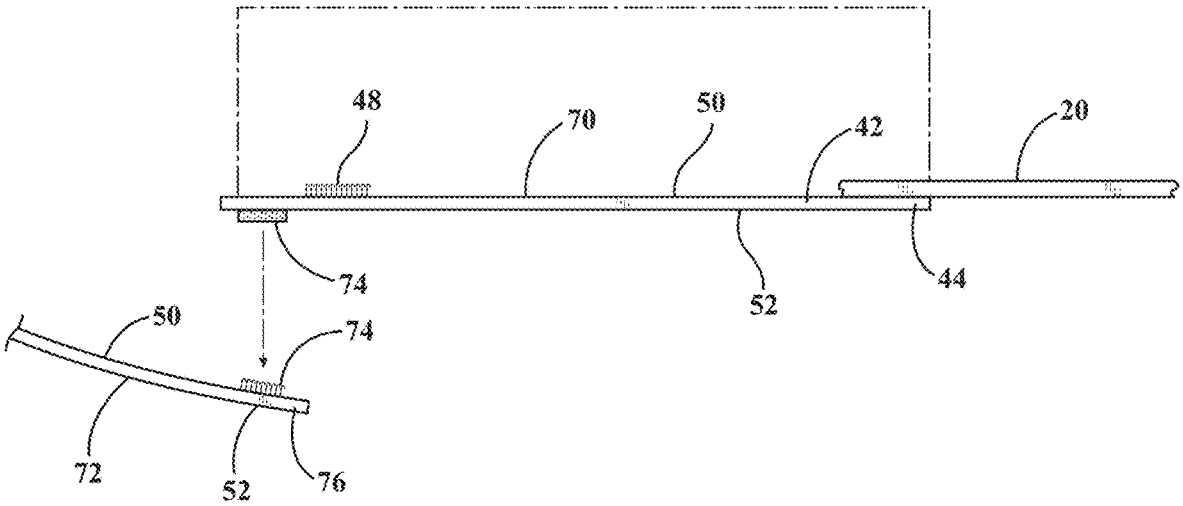
FIG. 12 is an exploded partial top plan view of the surgical garment and the strap of the surgical garment of FIG. 1, with the surgical garment cut-away for clarity.
Figure 13:
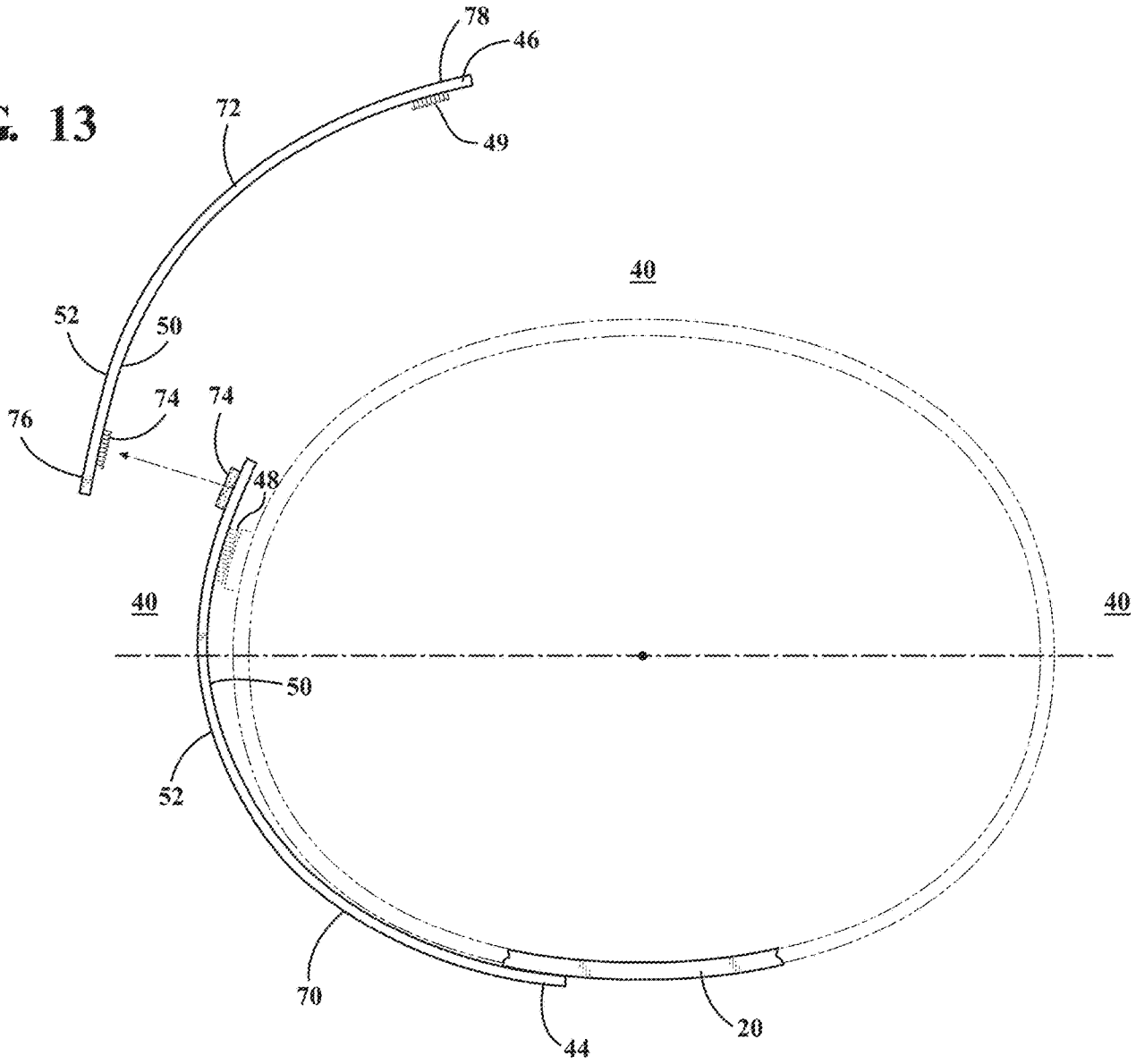
FIG. 13 is a partially-exploded top plan view of the surgical garment and strap of the surgical garment of FIG. 1, with the surgical garment partially shown in phantom for clarity.

In some examples, such as the example illustrated in FIG. 8, the back 28 defines a rear mid-line 34 of the surgical garment 20. Moreover, it is also contemplated that one or more of the first side 30 and the second side 32 may include seams. In one example, the front 24 and back 28 of the surgical garment 20 may be manufactured in two separate pieces before being sewn together to form the surgical garment 20. In this example, the first and second sides 30, 32 may each include a seam which runs longitudinally down the side of the surgical garment 20. In another example, the surgical garment 20 may be manufactured in a single planar piece which is secured onto itself to form the surgical garment 20. In this example, only one of the first and second sides 30, 32 will include the seam which runs longitudinally down the side of the surgical garment 20. Additionally, it is contemplated that the surgical garment 20 may be manufactured in a single piece such that no seams are necessary.

The surgical garment 20 may also include cuffs 36 at an end of the sleeves to prevent contamination into the surgical garment 20 through the sleeves. The cuffs 36 may be considered sterile, however, the cuffs 36 may be covered with surgical gloves to completely close off access into the surgical garment 20 from the arm area.

Establishing and maintaining a sterile field when performing surgical or other invasive procedures prevents microbial contamination, which can pose a risk of infection for patients. Sterile technique begins when the operating team members enter the operating room and prior to donning surgical attire. As such, the operating team members donning and adjusting the surgical garment 20 should take care to maintain the sterile zone to maintain the sterile field.

Figure 25:
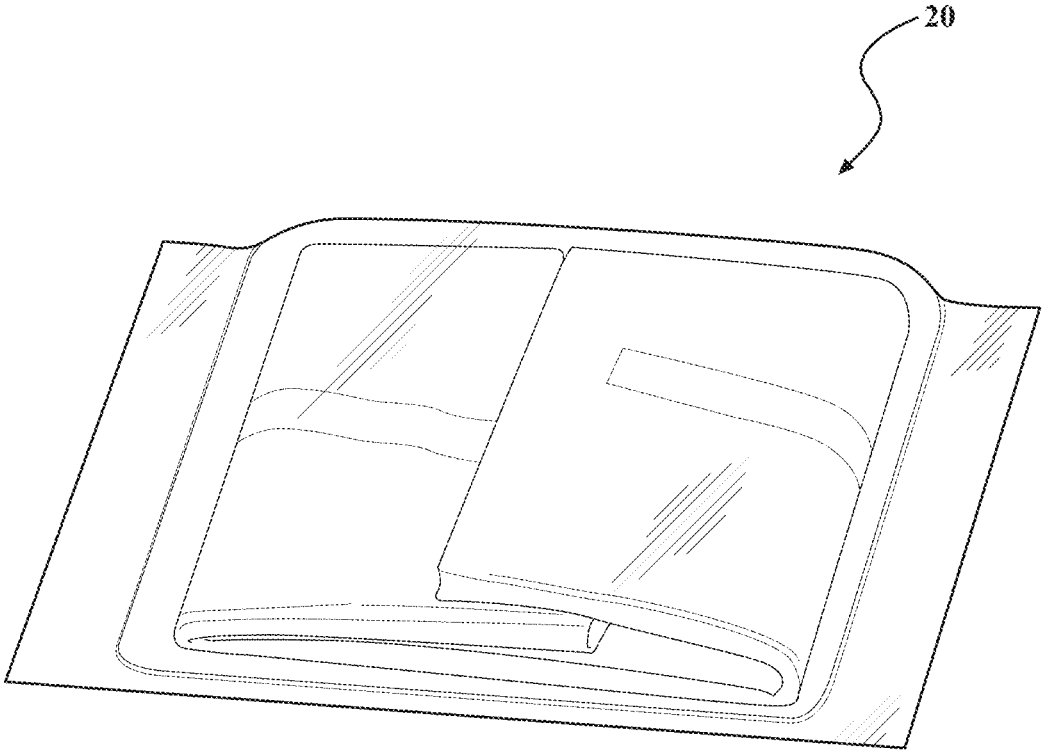
FIG. 25 is a front perspective view of a surgical garment in a sterilized package.

To this effect, and as illustrated in FIG. 25, each surgical garment 20 may typically be housed in a sterilized plastic package which remains sealed until the wearer opens the package in the operating room. The surgical garment 20 may be stored in a package in an inside-out orientation such that the wearer can don the surgical garment 20 without compromising the sterility of the outside of the surgical garment 20. In the package, the surgical garment may have a Sterility Assurance Level (SAL) of $10^{-3}$, or may have a Sterility Assurance Level (SAL) of $10^{-6}$. In the context of this disclosure, "SAL" means the probability of the surgical garment 20 being in a non-sterile condition after the surgical garment has been subjected to a sterilization process (and remains in the package free from further external contamination).

Figure 2:
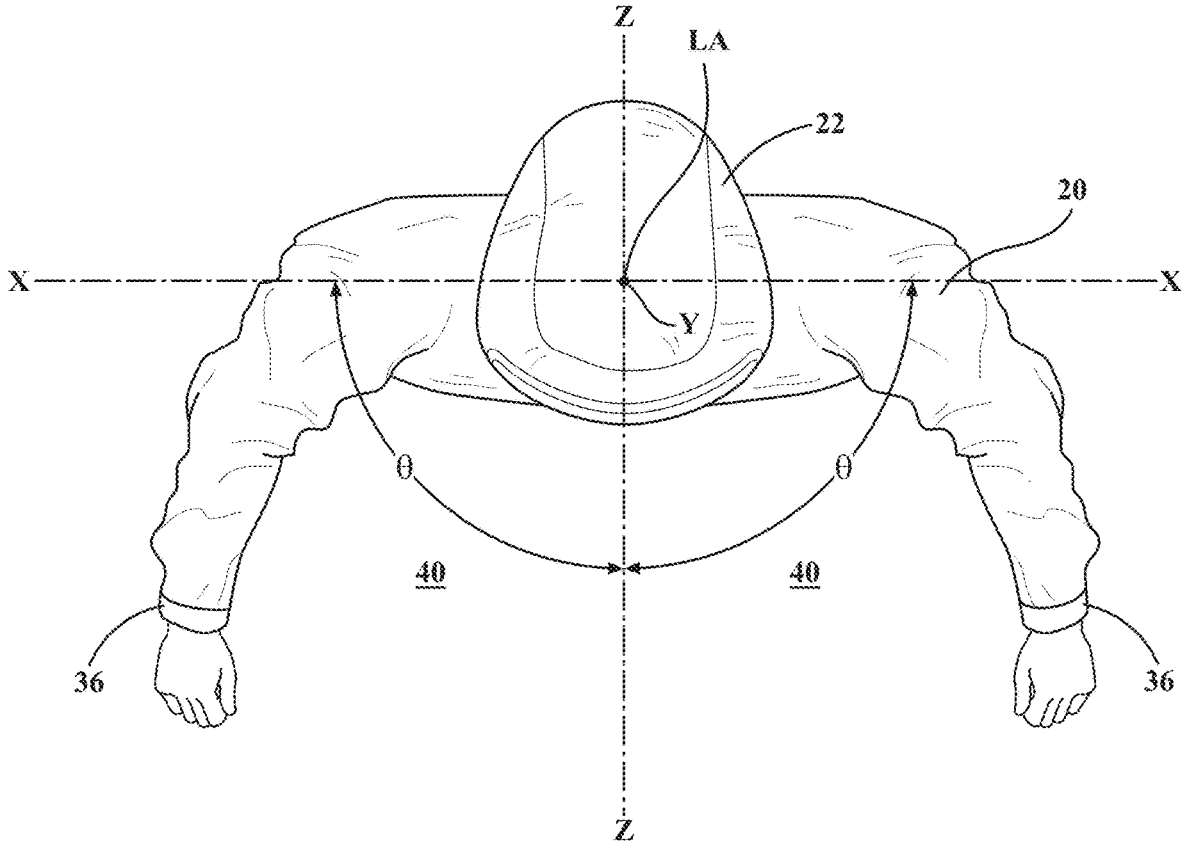
FIG. 2 is a top view of the surgical garment of FIG. 1, with the wearer's arms being outstretched.

As used herein, and as best illustrated in FIG. 2, the term "a region corresponding to the sterile zone" 40 corresponds with the sterile zone in an operating room according to the Association of periOperative Registered Nurses (AORN) guidelines on sterile technique. According to the AORN guidelines, once a surgical garment 20 is donned onto a wearer, the surgical garment 20 is considered sterile in the front 24 of the surgical garment 20 from the chest of the wearer to the level of the sterile field. The level of the sterile field is typically waist level as waist level is the limit of a good visual field. However, it is also contemplated that the level of the sterile field may be the level at which the patient will be placed, such as the height of the operating table. Moreover, according to the AORN guidelines, the shoulders, neckline, and axillary regions of the surgical garment 20 are considered to be unsterile. Additionally, the back 28 of the surgical garment 20 is considered to be unsterile. Finally, the sleeves of the surgical garment 20 are considered to be sterile from approximately two inches above the elbow to the cuff of the surgical garment 20, circumferentially around the arm.

The region corresponding to the sterile zone 40 is at least partially defined as a region within ninety degrees in either direction of the centerline 26. Additionally, as best illustrated in FIG. 2 with respect to a three dimensional Cartesian coordinate system, the region corresponding to the sterile zone 40 is defined in the x-direction as ninety degrees in either direction from an intersection of a coronal and sagittal plane of the wearer adjacent the wearer's body. In FIG. 2, this intersection is labeled as a longitudinal axis (LA) of the wearer. More particularly, the region corresponding to the sterile zone 40 may be represented by angle $\alpha$. Angle $\alpha$ is bisected by the sagittal plane of the wearer, with its vertex on the garment adjacent to the front centerline 26. Angle $\alpha$ may range from 120 to 180, 130 to 170, or from 140 to 160 degrees.

The region corresponding to the sterile zone 40 may also be defined in the y-direction from the chest of the wearer to the waist of the wearer anterior the coronal plane of the wearer; and the region corresponding to the sterile zone 40 is defined in the z-direction from the front 24 of the surgical garment 20 to the length of an outstretched arm of the wearer when the wearer's arm is parallel to the transverse plane of the wearer within the region corresponding to the sterile zone 40 in the x-direction.

Referring now to the example illustrated in FIGS. 3-13, the surgical garment 20 also includes a strap 42 having a first end portion 44, a second end portion 46, and fastening portion 48. As best illustrated in FIGS. 3A and 8, the first end portion 44 of the strap 42 is attached to the back 28 of the surgical garment 20, and more specifically, attached offset of the rear mid-line 34 of the back 28 of the surgical garment 20. The first end portion 44 of the strap 42 is typically sewn or otherwise stitched to the back 28 of the surgical garment 20, however, the first end portion 44 may be otherwise permanent attached. The stitching or other attachment mechanism must provide sufficient strength to allow tightening of the straps without ripping or detaching. However, it is also contemplated that the first end portion 44 of the strap 42 may be attached to another location of the garment including but not limited to other portions of the back 28 of the surgical garment 20 or to the side of the garment 20. The second end portion 46 is opposite the first end portion 44 of the strap 42.

Referring still to FIGS. 3-13, the fastening portion 48 of the strap 42 is configured to be removably coupled to a portion of the surgical garment 20. In one example, the fastening portion 48 is disposed on an interior side 50 of the strap 42 such that the fastening portion 48 of the strap 42 may comprise a removable coupling device such as a hook and loop arrangement, a snapping arrangement, a buttoning arrangement, or the like. According to one example, the fastening portion 48 of the strap 42 may comprise hooks that are configured to removably couple to any portion of the surgical garment 20. Additionally, the fastening portion 48 is configured to be removed from the garment and re-coupled at another location. Moreover, in one example, the fastening portion 48 may be removably coupled to a portion of the garment such that the second end portion 46 is in a sterile zone 40 of a wearer when the surgical garment 20 is in the sterile package and prior to adjustment after donning of the surgical garment 20.

In the example illustrated in FIGS. 3-13, the strap 42 includes an exterior side 52 opposite the interior side 50 which are joined together to form the strap 42. As best illustrated in FIGS. 9-13, the exterior side 52 is an outwardly facing side when the strap 42 is coupled to the garment at the fastening portion 48, and the interior side 50 is the side which includes the fastening portion 48 and is fastened to the surgical garment 20. However, it is also contemplated that this configuration could be switched, or in an example in which the surgical garment 20 includes multiple straps 42, each strap 42 may be of a different configuration. It is contemplated that the strap 42 may also include additional fabric or cushioning between the exterior side 52 and the interior side 50 for strength or comfort purposes. In one example, the strap 42 may comprise a nylon webbing material. However, it is also contemplated that the strap 42 may comprise cotton, a plastic polymer, polyester, a combination thereof, or the like without departing from the spirit of the disclosure. It is also contemplated that the strap 42 may be additionally comprised of a flexible material or elastic material in order to allow some stretching around the wearer during fastening.

Additionally, a thickness of the strap 42 may be approximately 5-15 millimeters (mm), with one example having a thickness of approximately 7-10 mm and more specifically approximately 8 mm. However, it is contemplated that the thickness of the strap 42 may be any thickness, e.g., to provide a desired level of strength and/or comfort for the user. Moreover, the strap 42 may have a length sufficient to securely fasten the strap 42 around a wearer of any size. For example, in one example, the length of the strap 42 may be approximately 25-150 centimeters (cm), with one implementation having a length of approximately 50-100 cm, and more specifically, approximately 80 cm. Additionally, the strap 42 may have a width sufficient to securely tighten the strap 42 and provide the desired strength. In one example the width of the strap 42 is approximately 20-80 mm, with one implementation having a width of approximately 40-60 mm, and more specifically, approximately 50 mm.

As illustrated in in FIGS. 3-7, the strap 42 is configured to be moved between a starting position (see FIG. 3) where the fastening portion 48 is removably coupled to one of the sides 30, 32 or rear of the surgical garment 20 and a tightened position (see FIG. 7) where the fastening portion 48 is removably coupled to the front 24 of the surgical garment 20. More specifically, in the starting position (FIG. 3), the fastening portion 48 is removably coupled to a portion of the garment 20 such that the second end portion 46 of the strap 42 is in the region corresponding to the sterile zone 40 of the wearer. It is contemplated that the second end portion 46 may be partially or fully disposed within the region corresponding to the sterile zone 40 of the wearer. For example, the second end portion 46 of the strap 42 may be at least partially disposed within the region corresponding to the sterile zone 40 of the wearer such that the wearer can engage the second end portion 46 of the strap 42 without moving their hands from the region corresponding to the sterile zone 40. Additionally, when the strap 42 is moved to the tightened position (FIG. 7), the second end portion 46 is moved toward the centerline 26 of the surgical garment 20 such that the second end portion 46 is at least partially, and typically, fully disposed within the region corresponding to the sterile zone 40 of the wearer.

Figure 3A:
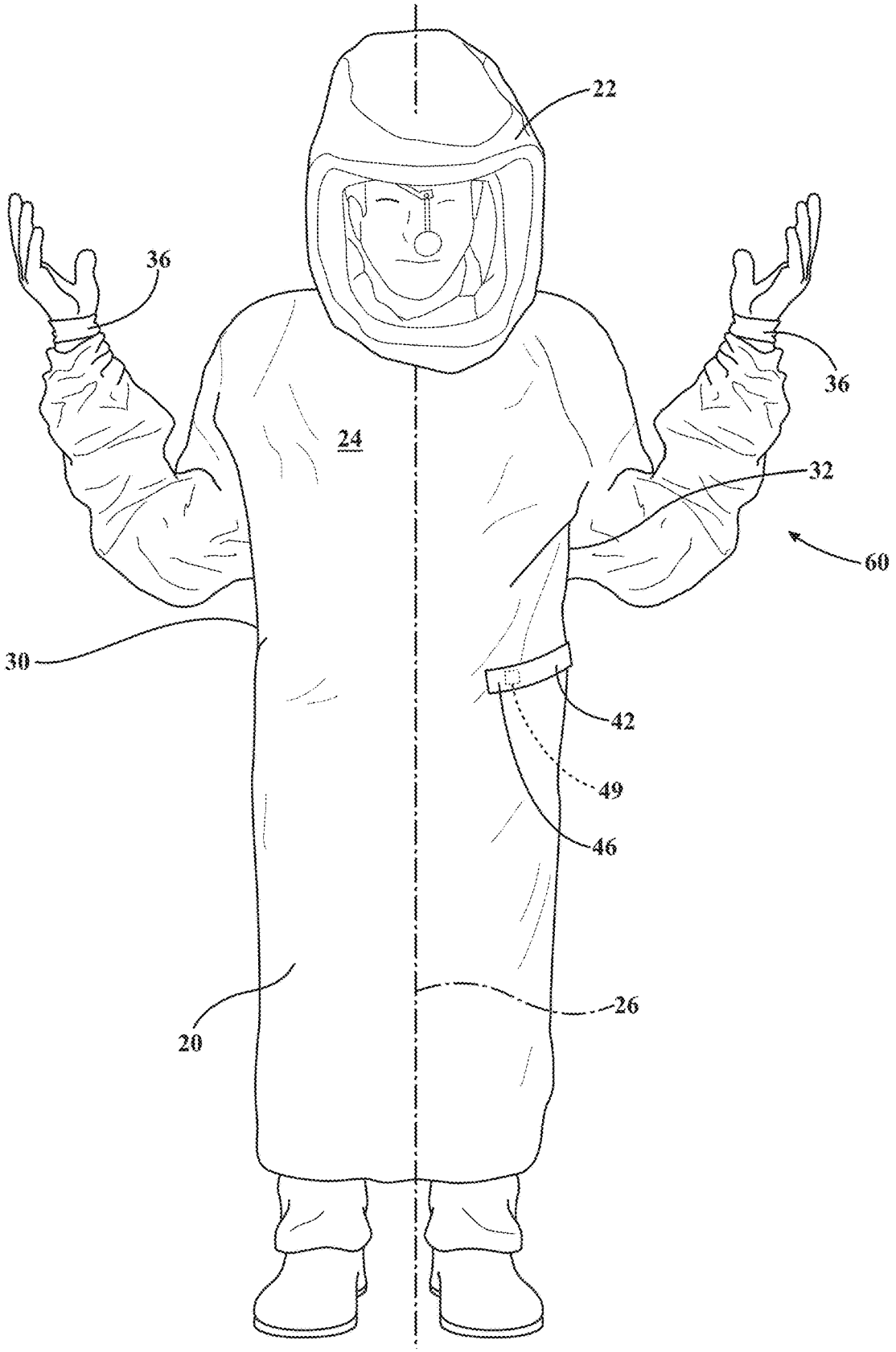
FIG. 3A is a front perspective view of the surgical garment of FIG. 1 having a strap comprising a first segment and a second segment in a starting position.
Figure 3B:
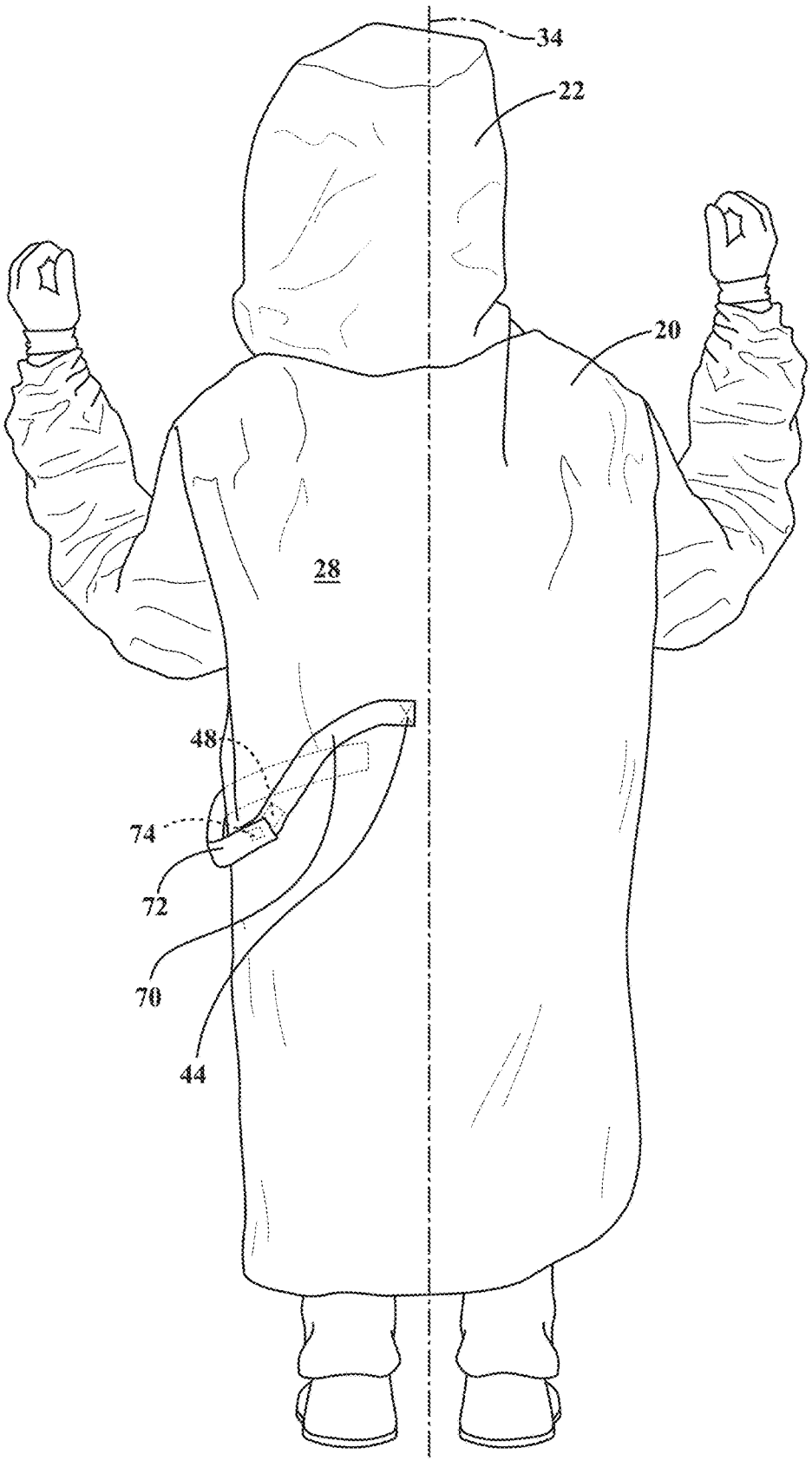
FIG. 3B is a rear perspective view of the surgical garment of FIG. 1 having the strap comprising the first segment and the second segment in the starting position
Figure 4:
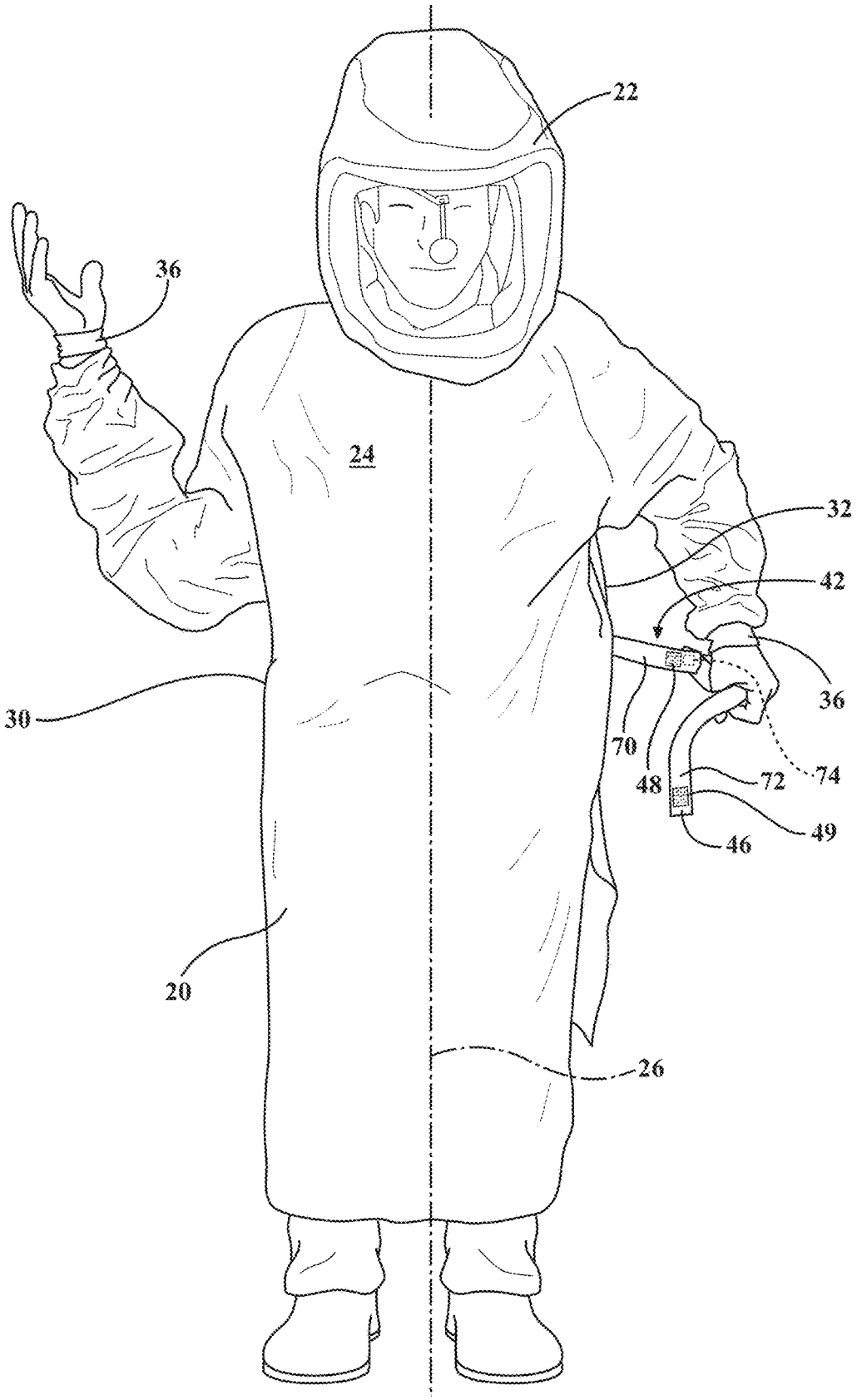
FIG. 4 is a front perspective view of the surgical garment of FIG. 1 having the strap being grasped by the wearer without the wearer's hands exiting a region corresponding to a sterile zone.
Figure 5:
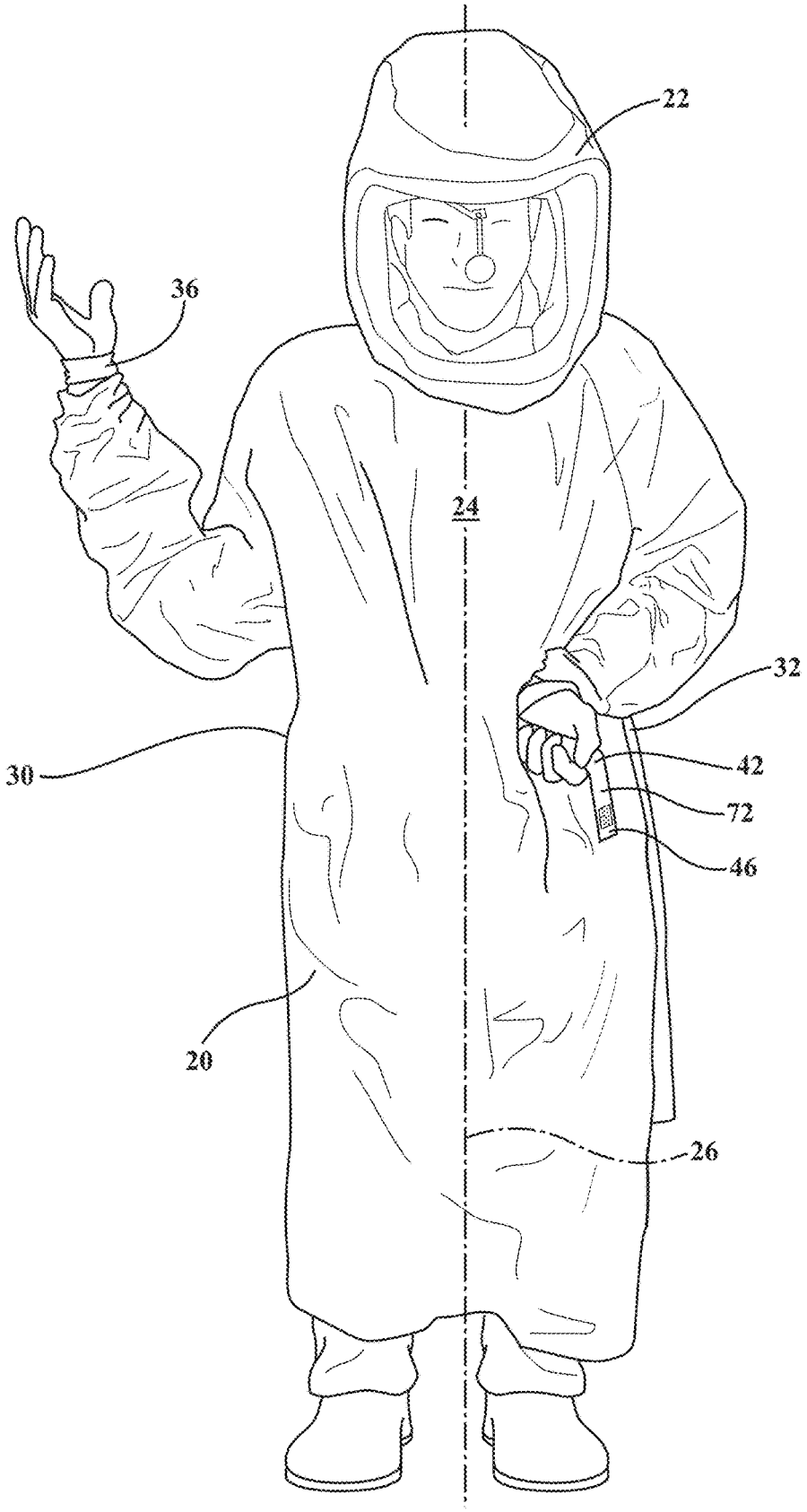
FIG. 5 is a front perspective view of the surgical garment of FIG. 1 having the strap being moved to the tightened position.
Figure 6:
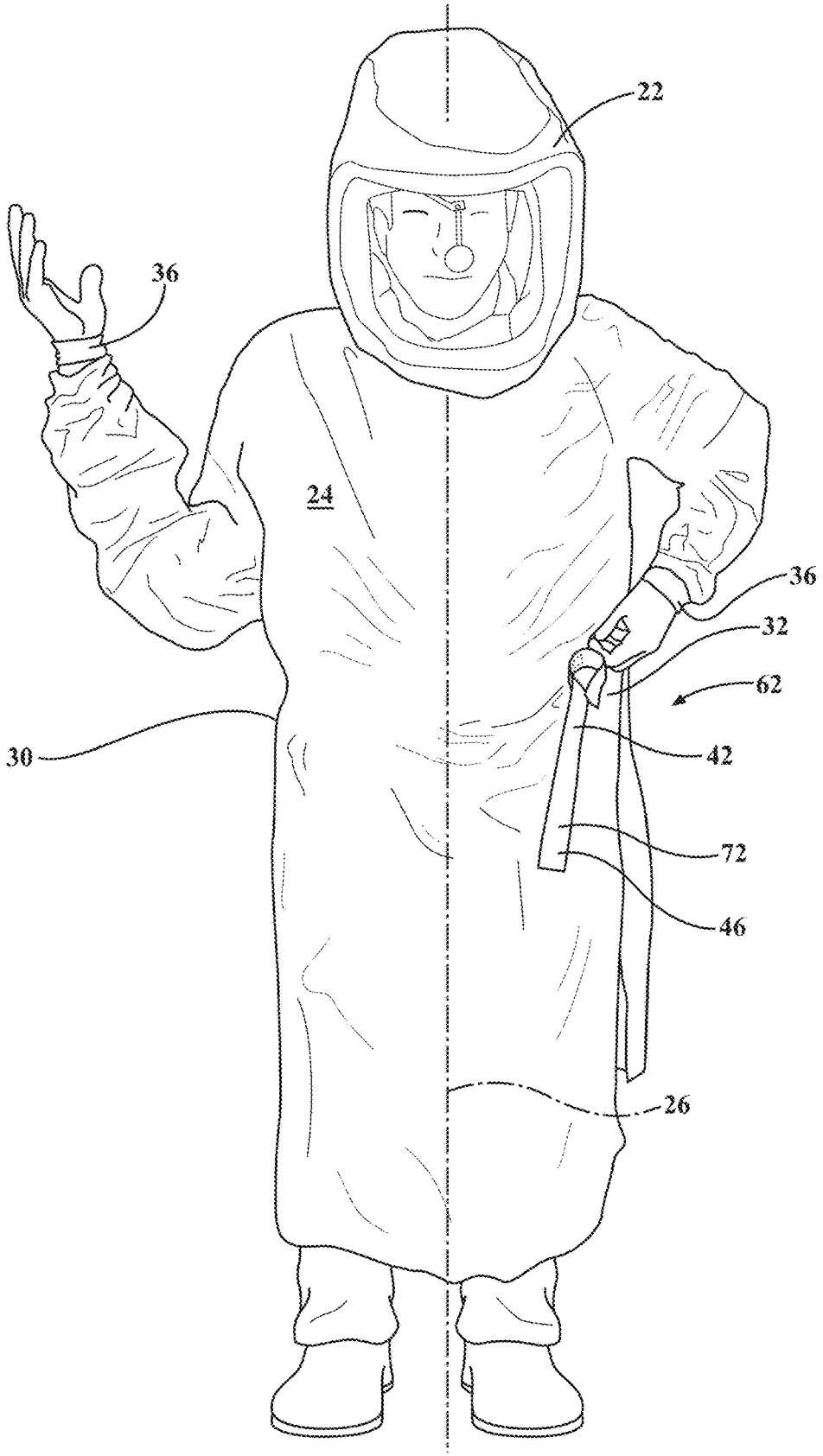
FIG. 6 is a front perspective view of the surgical garment of FIG. 1 having the strap in the tightened position prior to removing the second segment of the strap.
Figure 7:
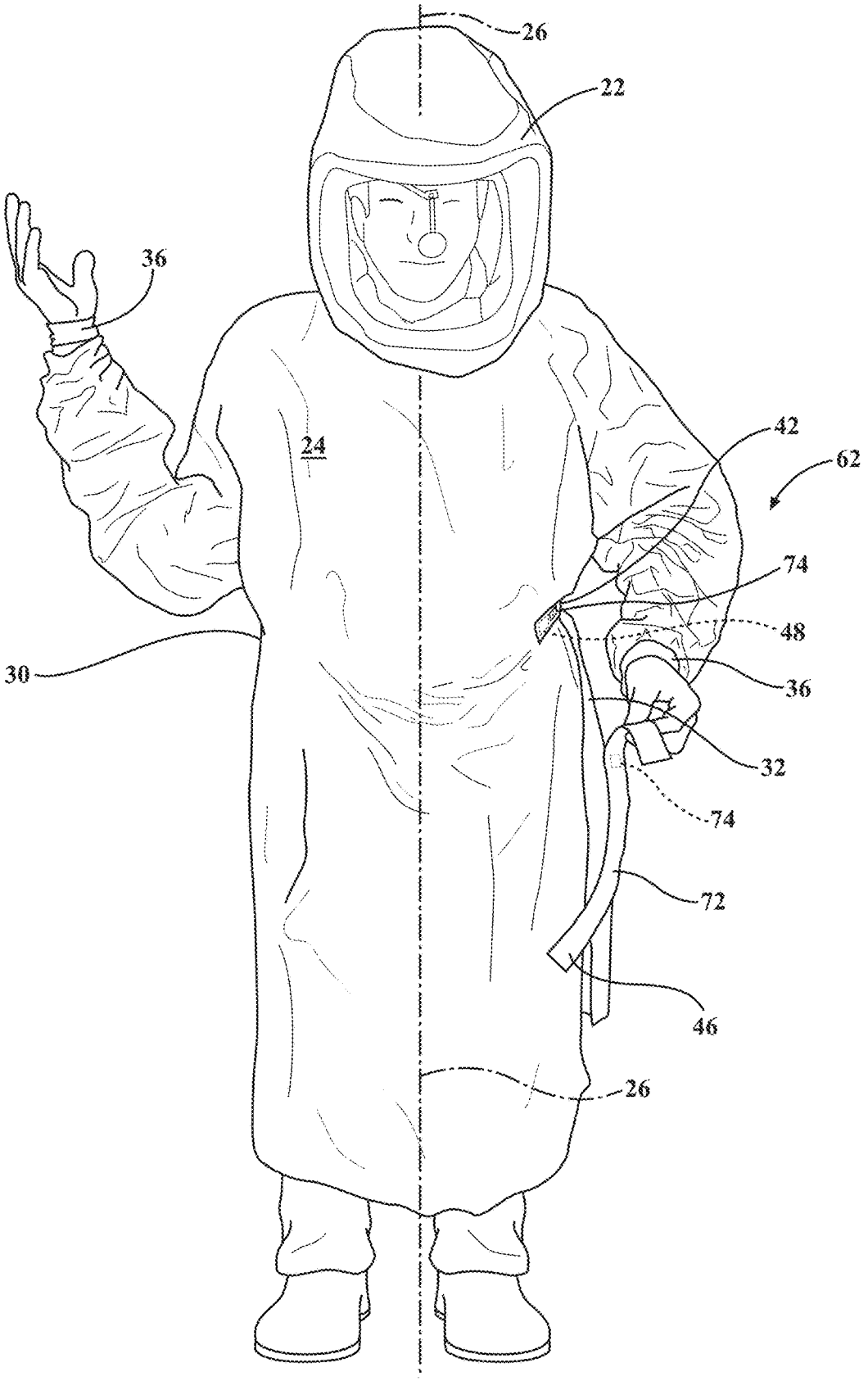
FIG. 7 is a front perspective view of the surgical garment of FIG. 1 having the strap in the tightened position after removing the second segment of the strap.

The tightened position (FIG. 7) may be any position closer to the centerline 26 than the starting position (FIG. 3). The tightened position (FIG. 7) may be slightly different for each wearer depending on the wearer's body size and shape. For example, the tightened position (FIG. 7) for a wearer of smaller than average size would require more distance between the starting position (FIG. 3) and the tightened position (FIG. 7) than the tightened position (FIG. 7) for a wearer of larger than average size. In other words, the tightened position (FIG. 7) can be adjusted within the region corresponding to the sterile zone 40 of the wearer to secure the gown 20 of a wearer of any size. It is contemplated that the strap 42 may cross the centerline 26 of the surgical garment 20, if necessary for tightening purposes. In other words, in the tightened position (FIG. 7), the second end portion 46 of the strap 42 may be in any location within the region corresponding to the sterile zone 40 of the wearer such that the wearer does not have to exit the region corresponding to the sterile zone 40 to fully tighten the surgical garment 20.

As illustrated in in FIGS. 3-13, the strap 42 may include a first segment 70 and a second segment 72. In an example, the second segment 72 defines the second end portion 46 and the second segment 72 may be separable from the first segment 70. Moreover, in the starting position (FIG. 3), the first segment 70 of the strap 42 may be at least partially disposed outside the region corresponding to the sterile zone 40 of the wearer and the second segment 72 of the strap 42 may be at least partially disposed within the region corresponding to the sterile zone 40 of the wearer. As best illustrated in FIGS. 9-13, the first segment 70 and the second segment 72 may include corresponding securing portions 74 to removably couple the first segment 70 and the second segment 72. Moreover, the first segment 70 may include the securing portion 74 disposed on the exterior side 52 of the strap 42 such that when the strap 42 is in the starting position (FIG. 3), the securing portion 74 faces away from the surgical garment 20. The corresponding securing portion 74 is disposed on the interior side 50 of the second segment 72 of the strap 42 such that when the strap 42 is in the starting position (FIG. 3), the securing portion 74B of the second segment 72 faces towards the surgical garment 20.

Referring still to FIGS. 3-13, the first segment 70 of the strap 42 may include the portion of the strap 42 which is fixedly coupled to the surgical garment 20, as described above. The second segment 72 of the strap 42 has a first end section 76 removably coupled to the first segment 70 and has an opposite end section 78 that defines the second end portion 46 of the strap 42. Additionally, in certain configurations, the first segment 70 and the second segment 72 overlap at least at the corresponding securing portions 74. It is also contemplated that the first and second segments 70, 72 may overlap for a length which does not include the corresponding securing portions 74. In other words, it is contemplated that the securing portion 74 on the strap 42 may be disposed anywhere on the first segment 70 such that the second segment 72 may overlap the first segment 70 along any or all of the length of the first segment 70. Additionally, it is contemplated that the first segment 70 may include multiple securing portions 74 and the second segment 72 may also include multiple corresponding securing portions 74. In one example, the corresponding securing portions 74 are corresponding hook and loop fasteners. However, it is contemplated that the corresponding securing portions 74 may be snap fasteners, button fasteners, or the like without departing from the spirit of the disclosure. In addition, it is contemplated that the first and second segments 70, 72 can be separated from one another through a perforated joint, without the use of a distinct fastener.

In one example, the corresponding securing portions 74 are of the type that stays secure when the wearer is pulling on the second segment 72 to move the strap 42 from the starting position (FIG. 3) to the tightened position (FIG. 7), but can easily be removed from the first segment 70 when pulled in the opposite direction. Therefore, the second segment 72 remains coupled to the first segment 70 during tightening of the strap 42 of the surgical garment 20, but may be easily released by the wearer when desired. In one exemplary example, directional micro hook and loop fasteners are used, however, various other fastening arrangements are also contemplated.

As best illustrated in FIG. 3A, the second segment 72 may also include an additional fastening portion 49 disposed on the second end portion 46 of the strap 42. The additional fastening portion 49 may be configured to secure the second end portion 46 of the strap 42 to the surgical garment 20 in order to ensure the second end portion 46 of the strap 42 remains in the region corresponding to the sterile zone 40 when the strap 42 is in the starting position (FIG. 3). In other words, the additional fastening portion 49 is removably coupled to the front 24 of the surgical garment 20 when the strap 42 is in the starting position (FIG. 3) which allows the wearer to grab the second end portion 46 of the strap 42 to move the strap 42 to the tightened position (FIG. 7) without removing their hands from the region corresponding to the sterile zone 40.

In one example, the surgical garment 20 may include an identical strap (not shown) attached to the surgical garment 20 on an opposite side of the rear mid-line 36 from the strap 42 described above. The additional strap will typically include the same features as the original strap 42 including the first segment 70, the second segment 72, the end portion 46, and the fastening portions 48. Moreover, the identical strap 42 may also be configured to be moved from the starting position to the tightened position by the wearer without removing the wearer's hands from the region corresponding to the sterile zone 40, as described above.

Referring still to FIGS. 3-13, in operation, the surgical garment 20 begins in an inside-out orientation and having the strap 42 in the starting position (FIG. 3) in the sterile package, as described in more detail above, i.e., with a second end portion 46 positioned in the region corresponding to the sterile zone 40 of the wearer. The wearer may then open the sterile package and don the surgical garment 20 without touching the outside of the garment 20. Once the surgical garment 20 has been donned by the wearer, the wearer may tighten the strap 42 of the surgical garment 20 around themselves. To that end, the wearer may engage the second end portion 46 of the strap 42 located in the region corresponding to the sterile zone 40 of the wearer and uncouple the fastening portions 48 and 49 from the surgical garment. The wearer may then move the strap 42 to the tightened position (FIG. 7) and re-couple the fastening portion 48 to the surgical garment 20. Once the strap 42 is moved to the tightened position (FIG. 7), the second segment 72 of the strap 42, if included, can be uncoupled from the first segment 70 of the strap 42 and then discarded. By using this configuration of the surgical garment 20 along with the disclosed method of adjusting the surgical garment 20, the wearer can adjust the surgical garment 20 without the help of an additional person and without the hands of the wearer leaving the region corresponding to the sterile zone 40, as compared to traditional approaches where assistance is needed.

Figure 18:
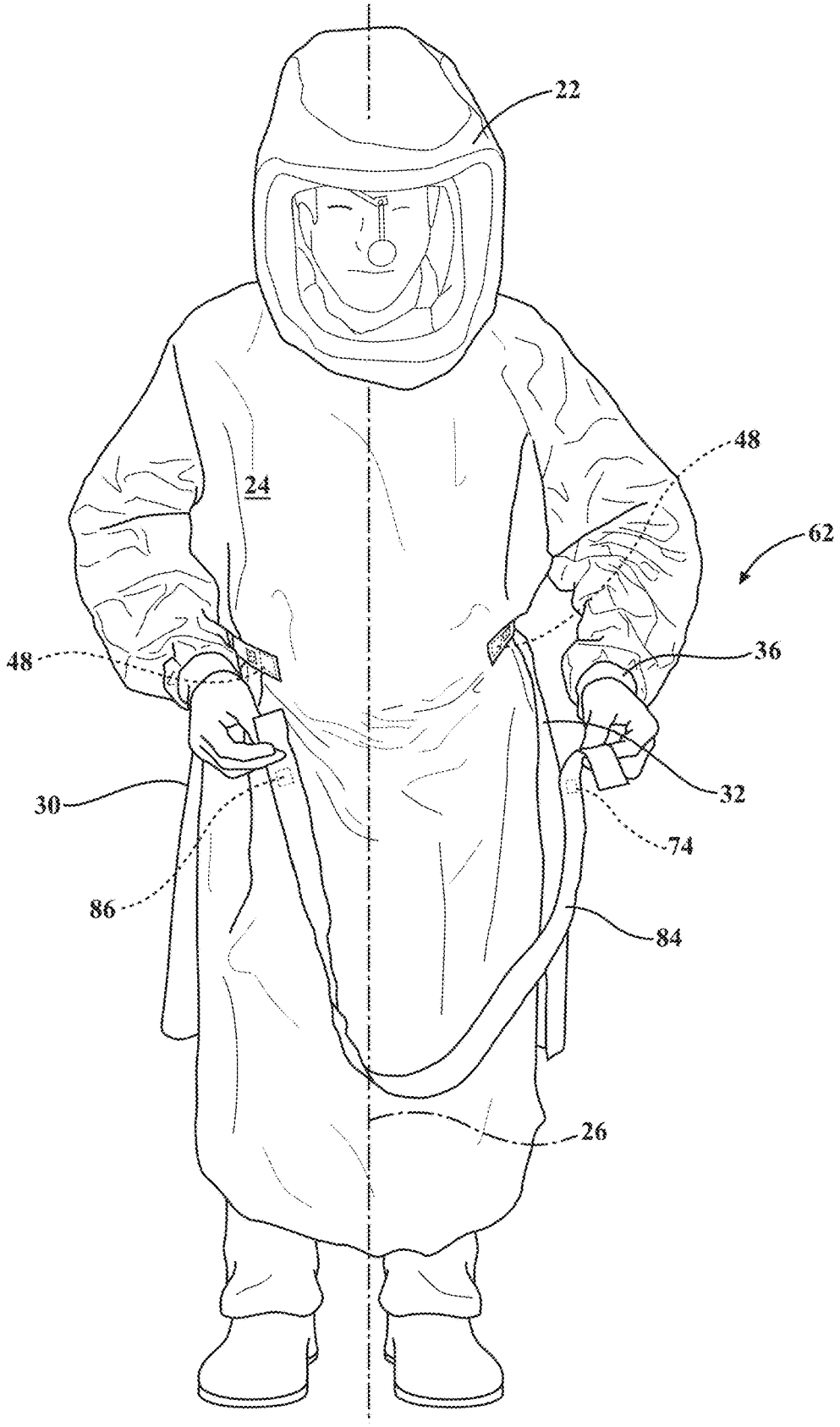
FIG. 18 is a front perspective view of the surgical garment of FIG. 14 having the first and second straps in the tightened position after removing the third strap.
Figure 19:
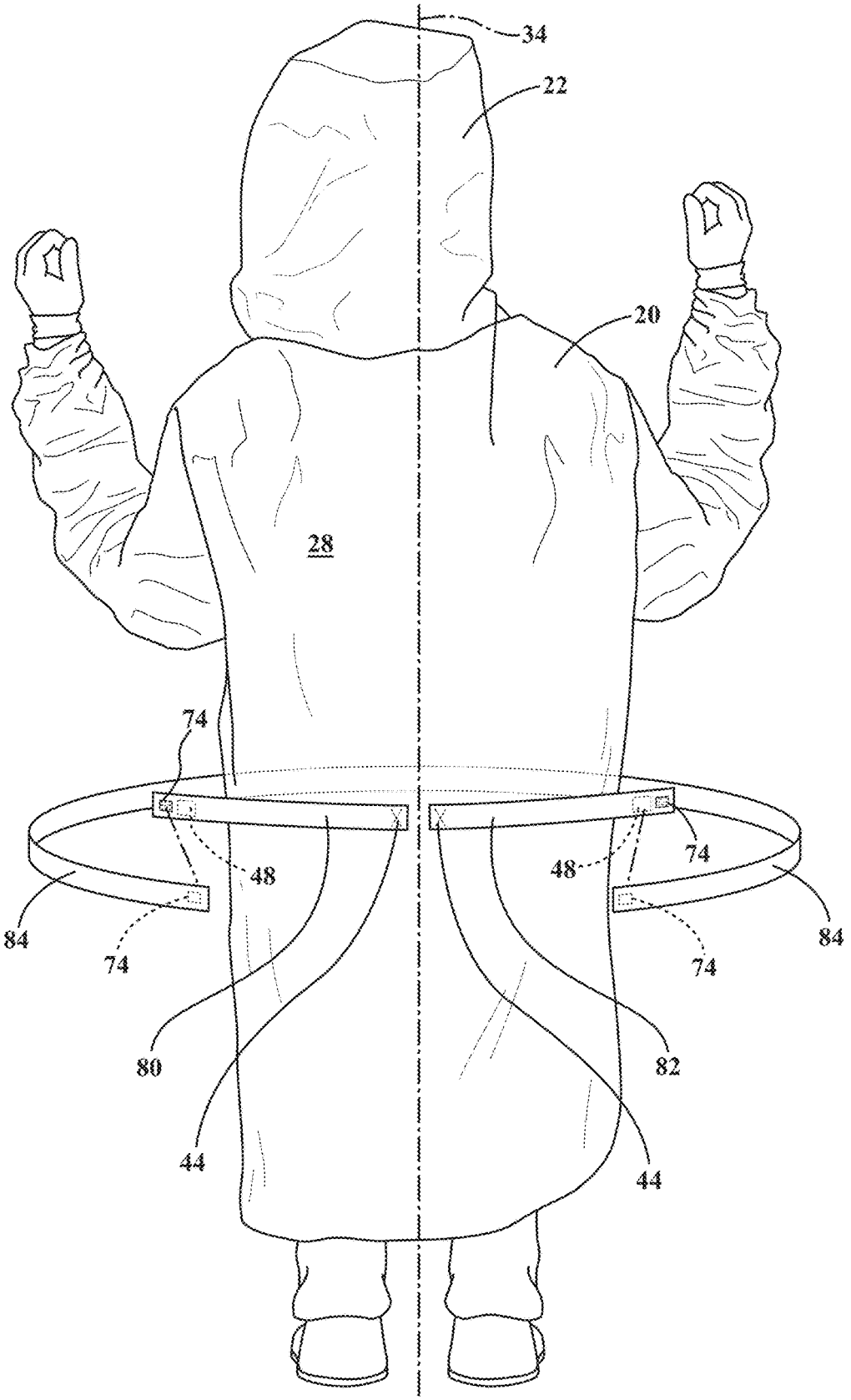
FIG. 19 is rear partially-exploded perspective view of the surgical garment of FIG. 14, with the third strap spaced apart from the first and second straps.
Figure 20:
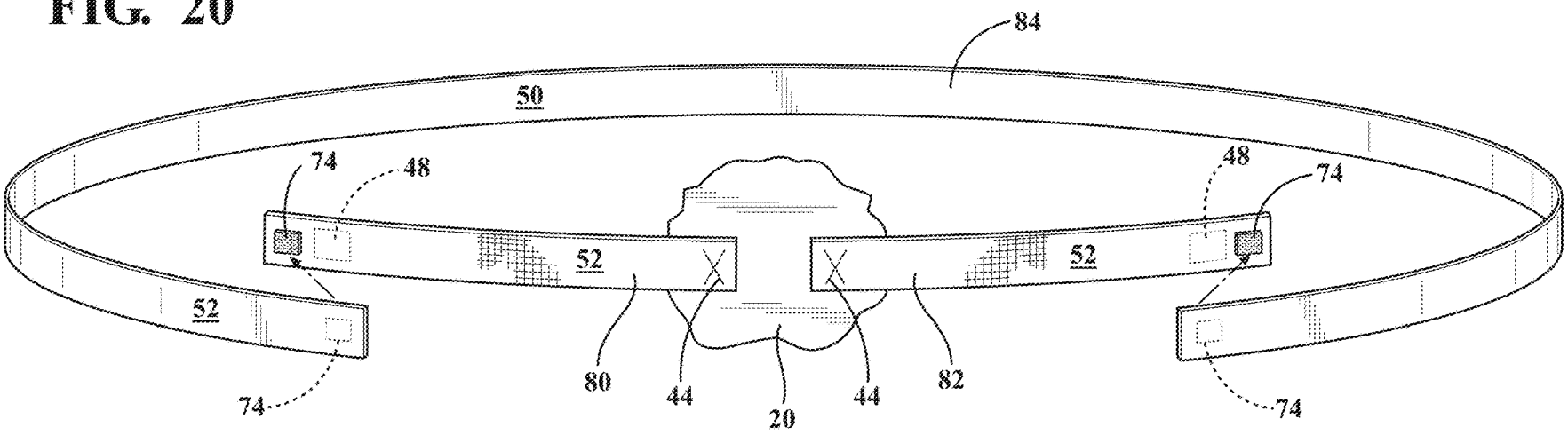
FIG. 20 is a rear partially exploded perspective view of the surgical garment and the straps of the surgical garment of FIG. 14, with the surgical garment cut-away for clarity.
Figure 21:
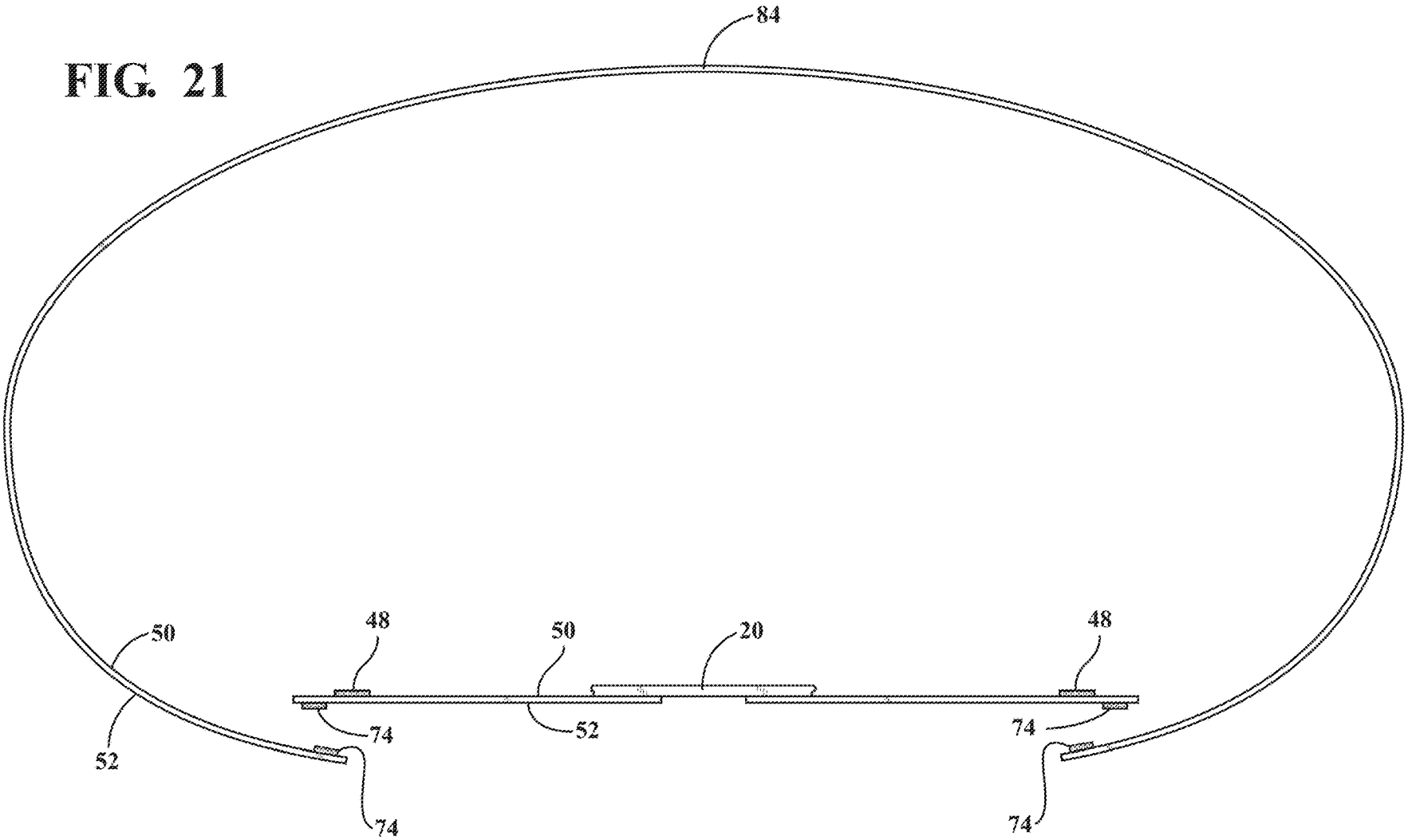
FIG. 21 is a top-side exploded plan view of the surgical garment and the straps of the surgical garment of FIG. 14, with the surgical garment cut-away for clarity.
Figure 22:
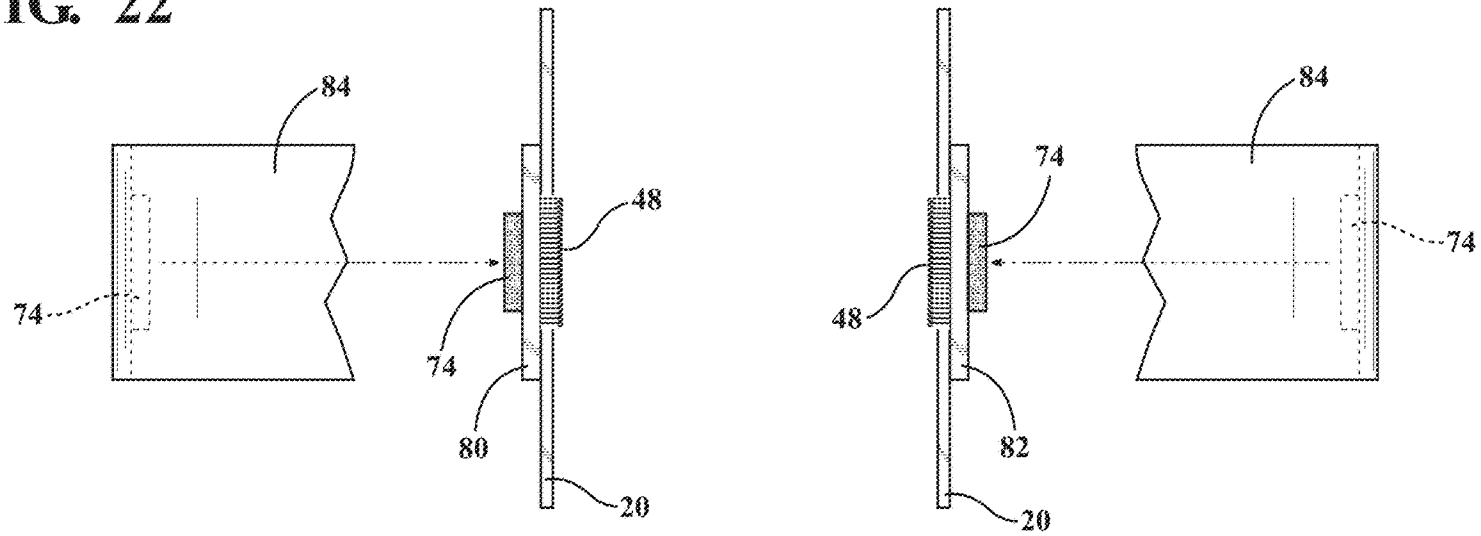
FIG. 22 is an exploded partial side plan view of the surgical garment and the straps of the surgical garment of FIG. 14, with the surgical garment cut-away for clarity.
Figure 23:
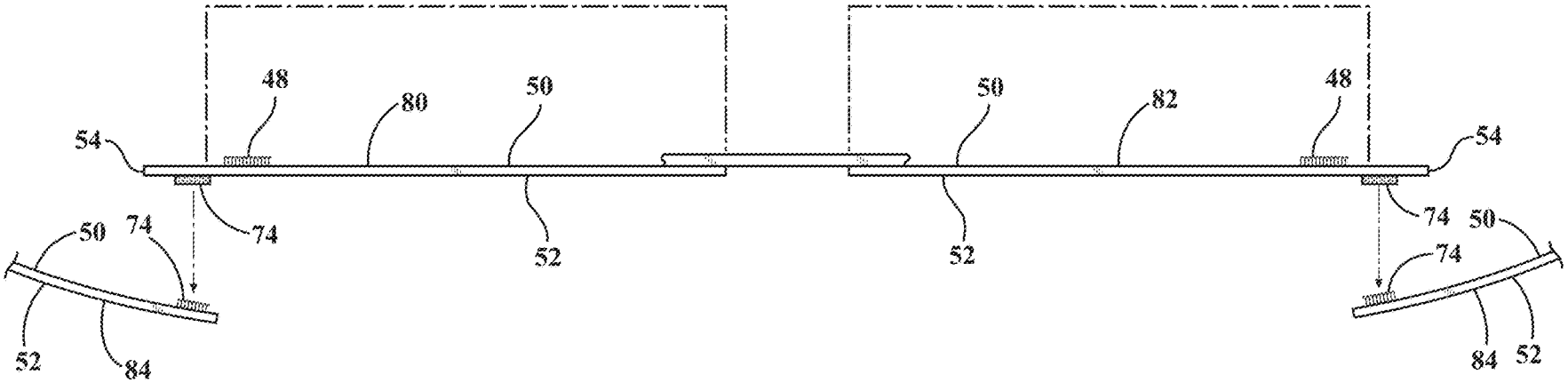
FIG. 23 is an exploded partial top plan view of the surgical garment and the straps of the surgical garment of FIG. 14, with the surgical garment cut-away for clarity.
Figure 24:
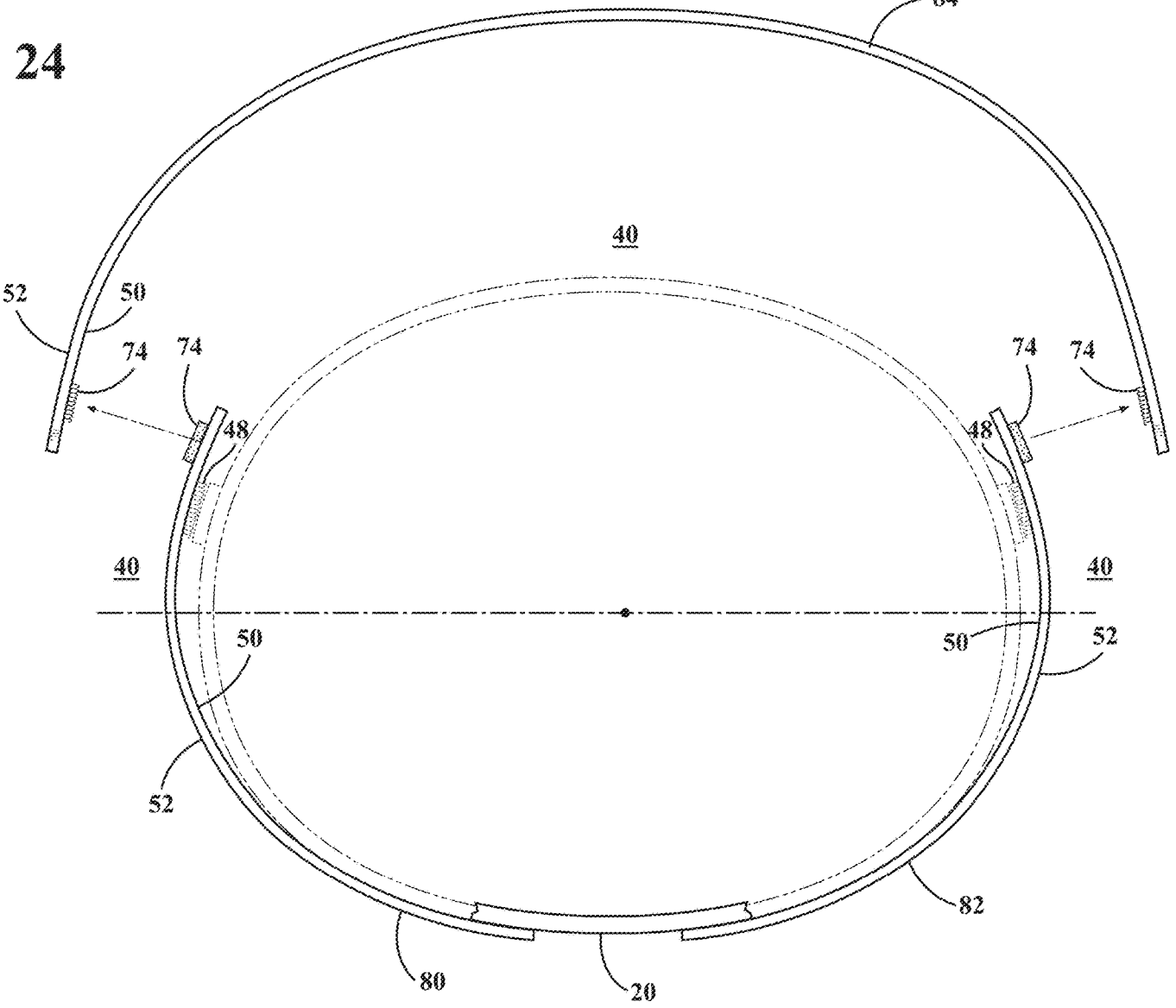
FIG. 24 is a partially exploded top plan view of the surgical garment and the straps of the surgical garment of FIG. 14, with the surgical garment partially shown in phantom for clarity.

In another example, illustrated in FIGS. 14-24, a strap 79 comprises a first strap 80 and a second strap 82 which each comprises respective first end portions 44, second end portions 46 disposed opposite of the first end portions 44, and fastening portions 48. Additionally, the strap 79 may comprise a third strap 84 which is removably coupled to both the first and second straps 80, 82. In some aspects, the third strap 84 may substantially similar to the second segment 72 described above with respect to FIGS. 4-13. More specifically, the third strap 84 includes securing portions 74 for removable coupling to the securing portions 74 of second end portions 46 of the first strap 80 and the second strap 82. As best illustrated in FIG. 19, the first and second straps 80, 82 are each attached at the first end portion 44 to the back 28. More specifically, the first and second straps 80, 82 are disposed on opposite sides of the rear mid-line 34 of the back 28 of the surgical garment 20. It is also contemplated that the first and second straps 80, 82 may be attached elsewhere on the back 28 of the surgical garment 20.

Figure 14A:
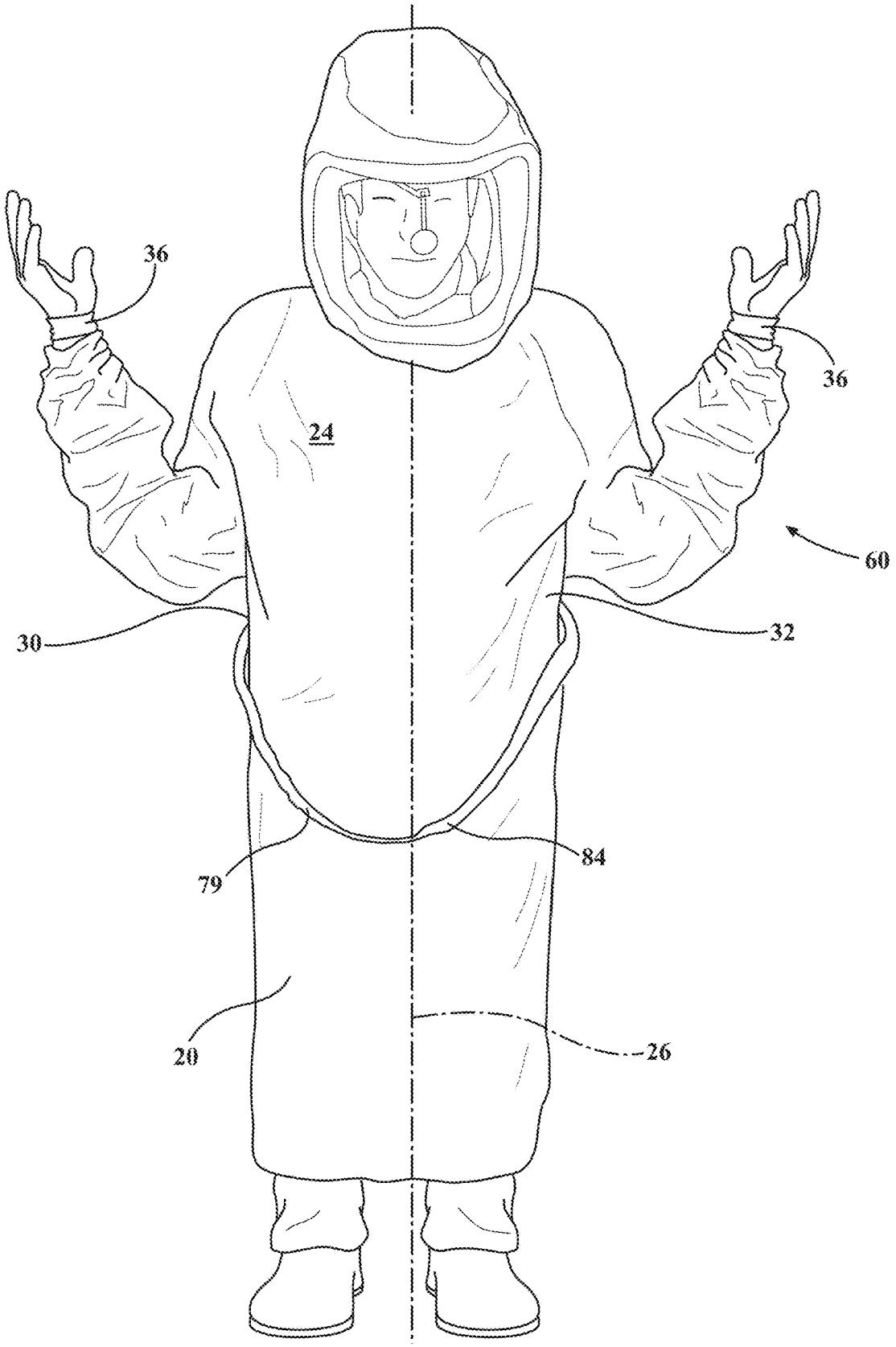
FIG. 14A is a front perspective view of a surgical garment according to another example having first and second straps in a starting position and a third strap coupled to the first and second straps.
Figure 14B:
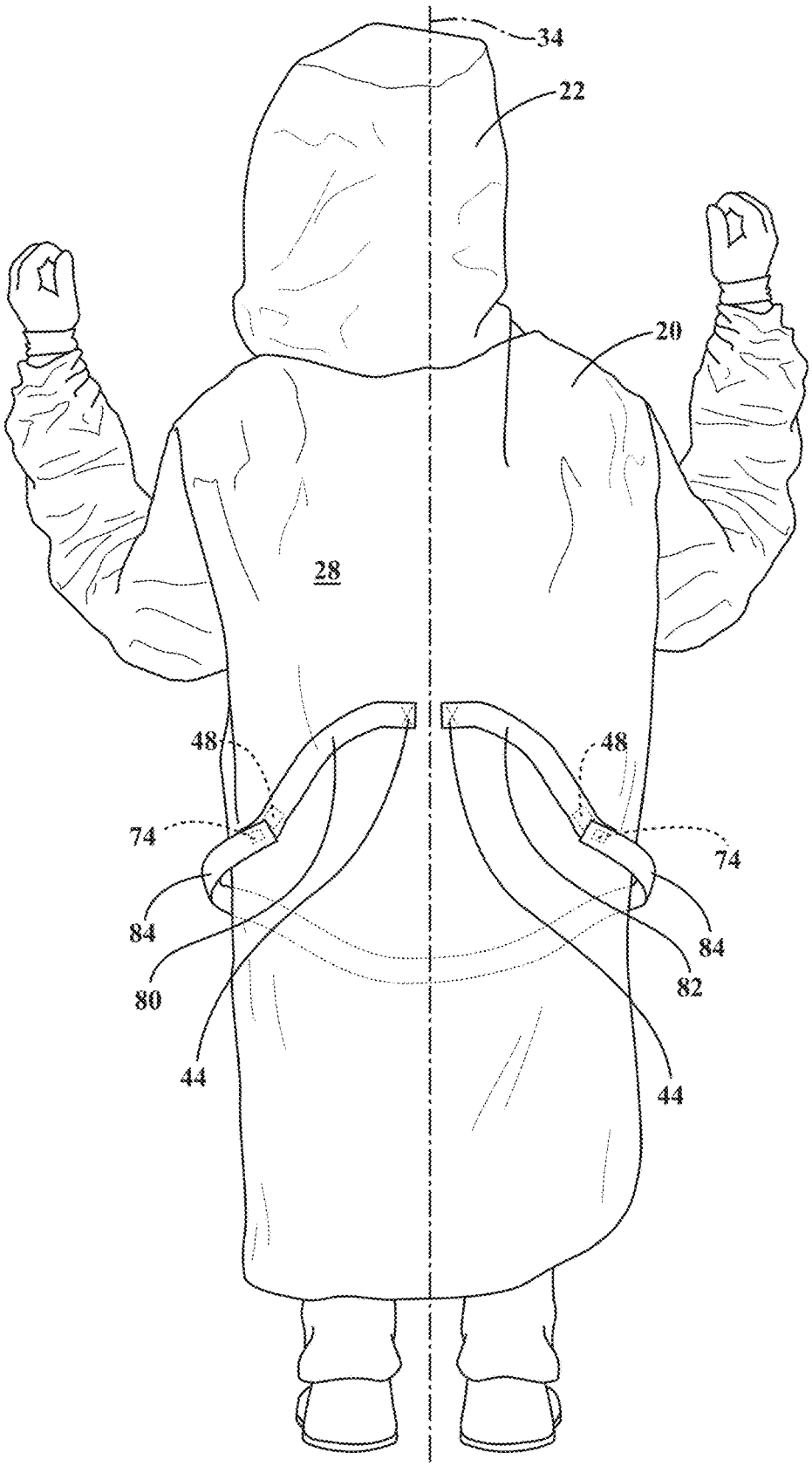
FIG. 14B is a rear perspective view of the surgical garment of FIG. 14A having the first and second straps in the starting position and the third strap coupled to the first and second straps.
Figure 15:
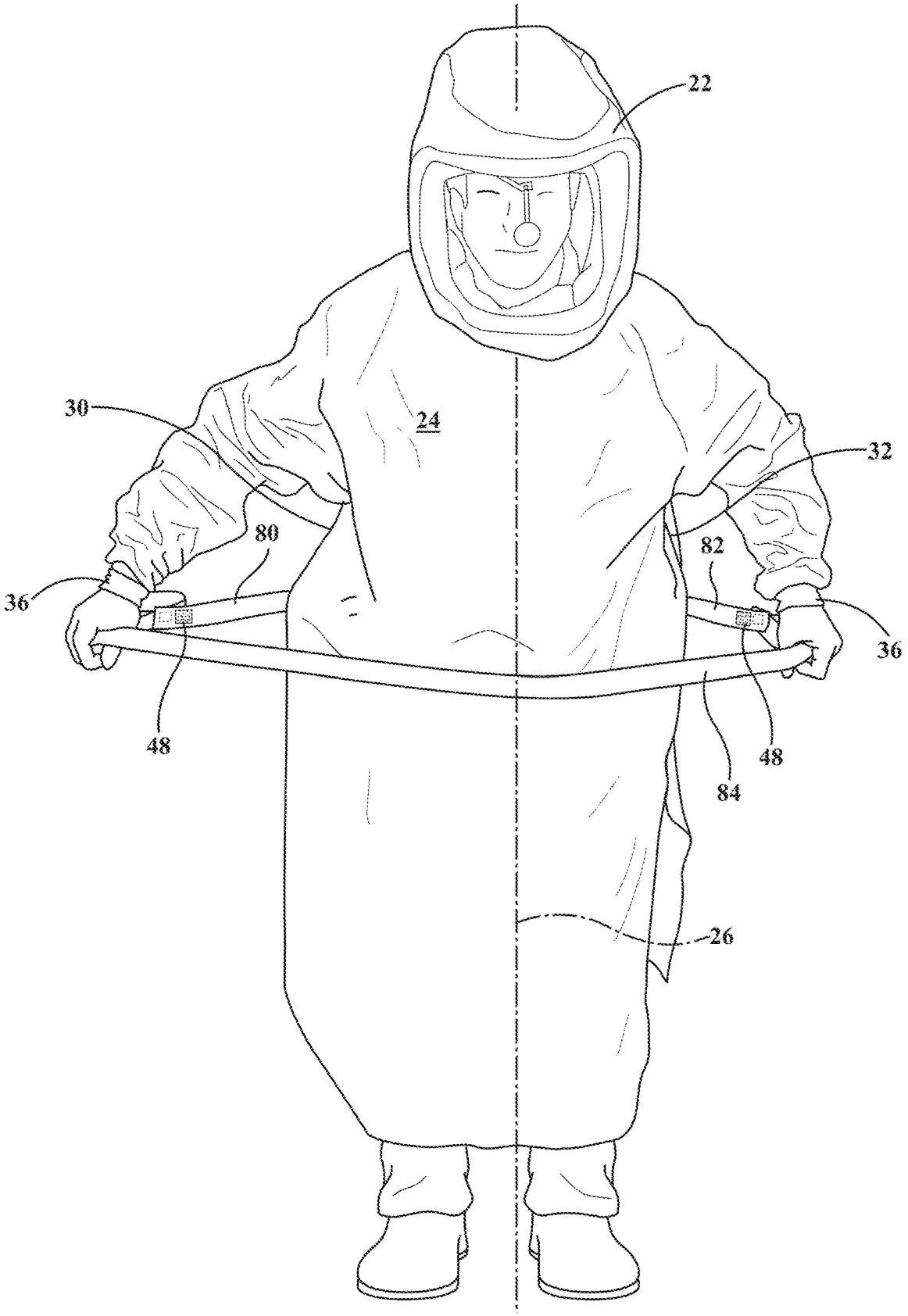
FIG. 15 is a front perspective view of the surgical garment of FIG. 14 having the third strap being grasped by the wearer without the wearer's hands exiting the region corresponding to the sterile zone.
Figure 16:
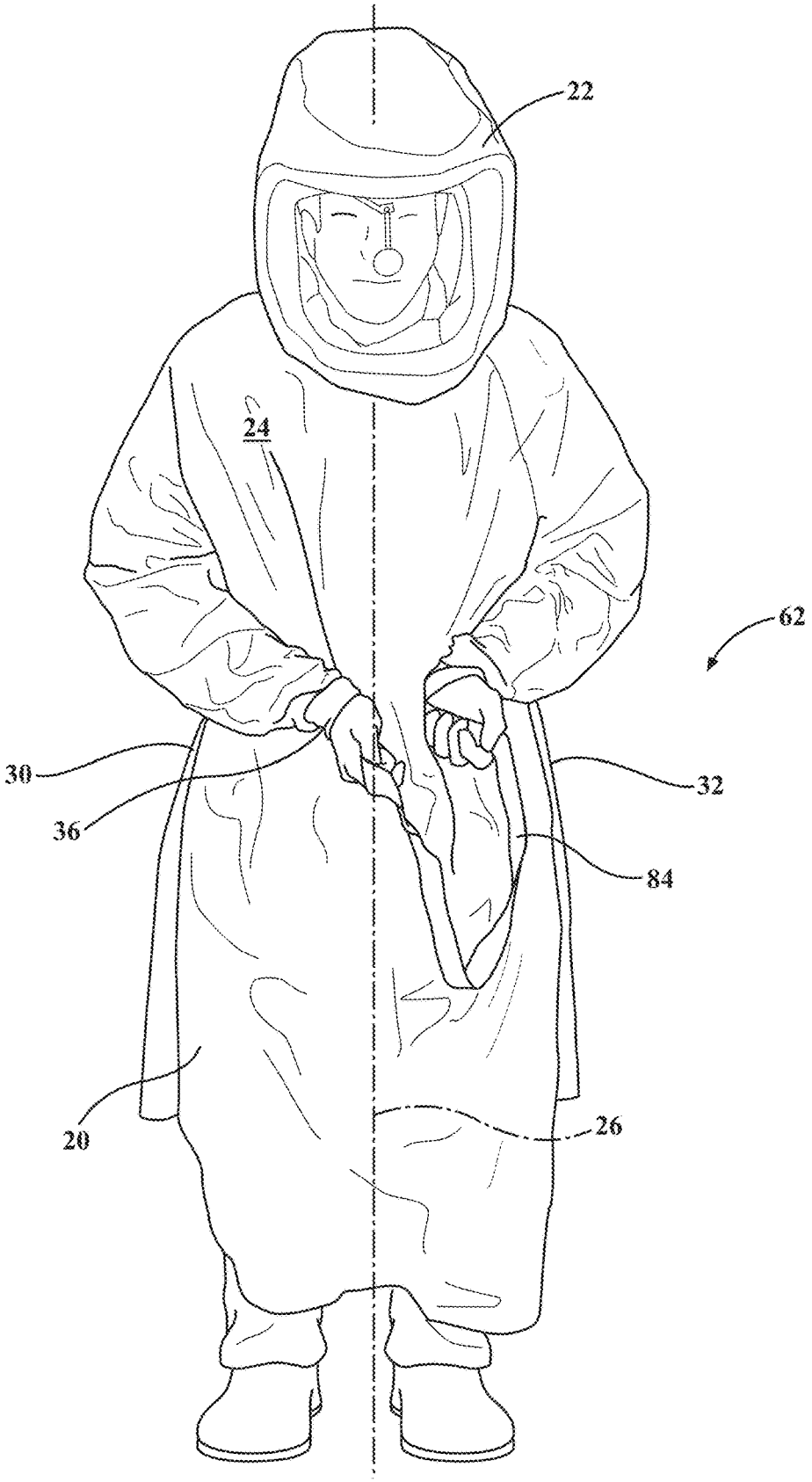
FIG. 16 is a front perspective view of the surgical garment of FIG. 14 having the first and second straps being moved to the tightened position.
Figure 17:
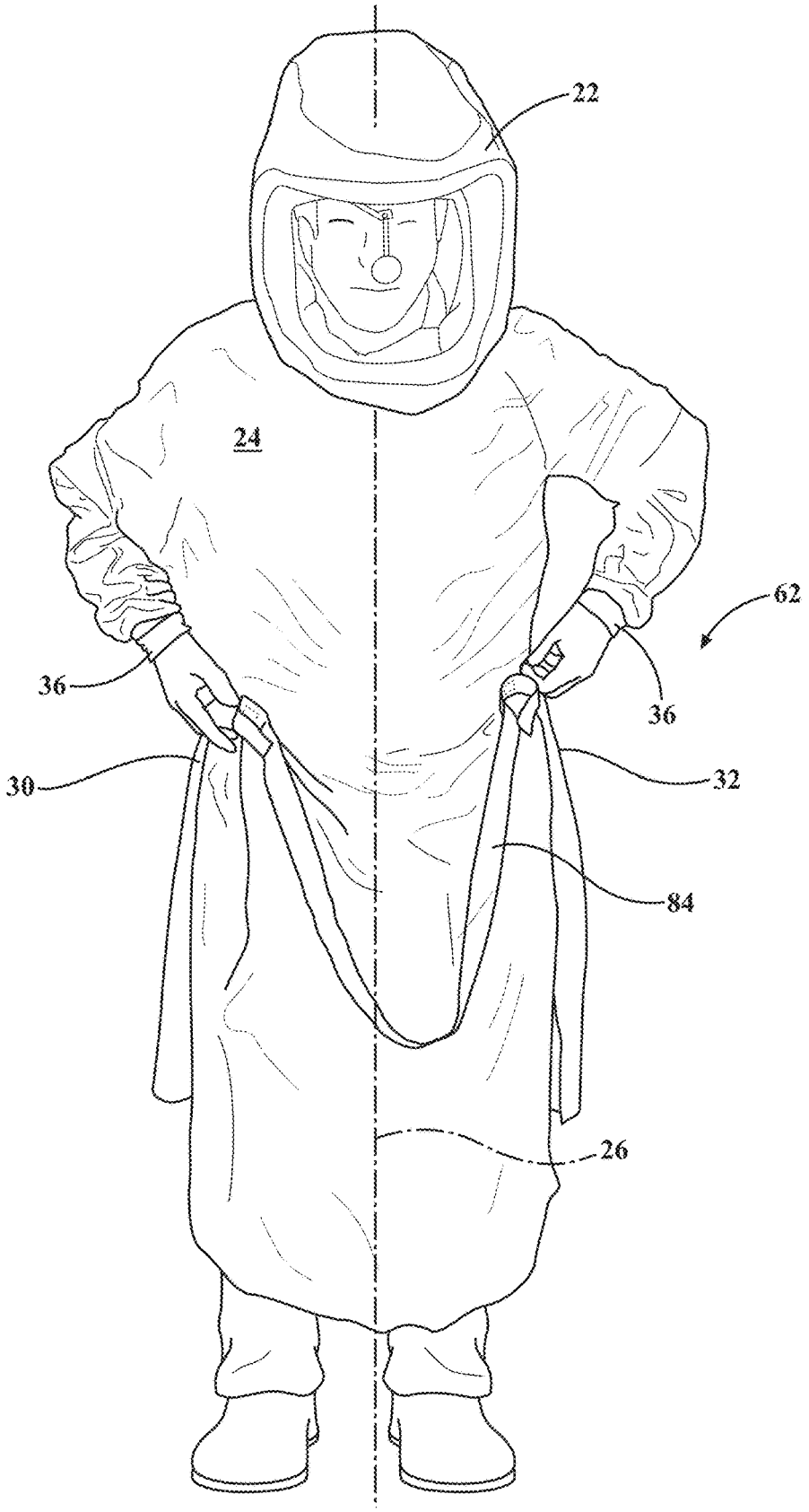
FIG. 17 is a front perspective view of the surgical garment of FIG. 14 having the first and second straps in the tightened position prior to removing the third strap.

Referring still to FIGS. 14-24, when the surgical garment 20 is in a sterile package as previously described, the first and second straps 80, 82 may be at least partially disposed outside the region corresponding to a sterile zone 40 of the wearer and the third strap 84 may be disposed at least partially within the region corresponding to the sterile zone 40 of the wearer. In other words, in the starting position (FIG. 14) of the first and second straps 80, 82, at least a portion of the first and second straps 80, 82 are disposed outside the region corresponding to the sterile zone 40 of the wearer and the third strap 84 is at least partially disposed in the region corresponding to the sterile zone 40 of the wearer. In one example, as illustrated in FIG. 14, the second end portion 46 of the first and second straps 80, 82 may be disposed on the sides 30, 32 or back 28 of the surgical garment 20 such that the entirety of the first and second straps 80, 82 are disposed outside of the region corresponding to the sterile zone 40. Moreover, the first and second straps 80, 82 are configured to be moved between the starting position (FIG. 14) and the tightened position (FIG. 18) where the fastening portion 48 is removably coupled to the front 24 of the surgical garment 20. Additionally, when the surgical garment 20 is in the sterile package, the configuration of the surgical garment 20 is typically inside-out, as described above.

As illustrated in the example shown in FIGS. 14-24, the third strap 84 may couple the second end portions 46 of first and second straps 80, 82 such that the third strap 84 is disposed between the first strap 80 and the second strap 82. Moreover, it is contemplated that the third strap 84 may be any length and preferably of a length sufficient to encompass the body of any size wearer, but not too long such that the third strap 84 would exit the region corresponding to the sterile zone 40 in the starting position (FIG. 14). More specifically, as described above, in the starting position (FIG. 14), as illustrated in FIG. 14, the first and second straps 80, 82 are at least partially disposed outside the region corresponding to the sterile zone 40 of the wearer, and the third strap 84 being coupled between the first and second straps 80, 82 is disposed at least partially within the region corresponding the sterile zone 40.

The third strap 84 allows a user to engage the portion of the third strap 84 located in the region corresponding to the sterile zone 40 and pull the first, second, and third straps 80, 82, 84 forward within the region corresponding to the sterile zone 40 until the desired tightness of the surgical garment 20 has been reached. The action of pulling on the third strap 84 will de-couple the fastening portions 48 of the first and second straps 80, 82 from the starting position (see FIG. 14) to allow movement of the straps to the tightened position (FIG. 18). Once the desired tightness has been reached, the user allows the fastening portions 48 of the first and second straps 80, 82 to re-couple with the surgical garment 20 in the region corresponding to the sterile zone 40 in the tightened position (FIG. 18). Once the first and second straps 80, 82 are in the tightened position (FIG. 18), the third strap 84 may be removed from the first and second straps 80, 82.

As described above, the third strap 84 includes the securing portions 74 adjacent each of its ends in order to removably couple the third strap 84 to the first and second straps 80, 82. Once the first and second straps 80, 82 are in the tightened position (FIG. 18), the wearer can uncouple each of the securing portions 74 of the third strap 84 from the first and second straps 80, 82. In one example, the securing portions 74 of the third strap 84 are of the type that stay secure when the wearer is pulling on the third strap 84 to move the first and second straps 80, 82 from the starting position (FIG. 14) to the tightened position (FIG. 18), but can easily be removed from the first and second straps 80, 82 when pulled in the opposite direction. Therefore, the third strap 84 may remain coupled to the first and second straps 80, 82 during tightening of the surgical garment 20, but be easily released by the wearer when desired. In one example, directional micro hook and loop fasteners are used, however, various other fastening arrangements are also contemplated.

It is contemplated that the first and second straps 80, 82 may include the same or similar features and orientations to the strap 42, including but not limited to the first end portion 44, the second end portion 46, the interior side 50, the exterior side 52, the thickness, the length, the width, the fastening portion 48, the securing portions 74. Moreover, it is contemplated that the first and second straps 80, 82 may be identical or similar to one another. However, it is also contemplated that the first and second straps 80, 82 may have any of the alternate features and/or configurations as described above with respect to the strap 42. Moreover, it is contemplated that each of the first and second straps 80, 82 may be different from one another without departing from the spirit of the disclosure.

Referring still to the example illustrated in FIGS. 14-24, in operation, the surgical garment 20 begins in the sterile package in the inside-out orientation, with the first and second straps 80, 82 in the starting position (FIG. 14). The wearer may then open the sterile package and don the surgical garment 20 without touching the outside of the garment 20. Once the surgical garment 20 has been donned by the wearer, the wearer may tighten the surgical garment 20 around themselves. To that end, the wearer may engage the third strap 84 situated in the region corresponding to the sterile zone 40 and pull the third strap 84 forward to tighten the first and second straps 80, 82 without having their hands exit the region corresponding to the sterile zone. When the first and second straps 80, 82 are moved to the tightened position (FIG. 18), the wearer may cease pulling of the third strap 84 which allows the first and second straps 80, 82 to re-engage with the surgical garment 20 in the tightened position (FIG. 18). The wearer can then uncouple the third strap 84 from the first and second straps 80, 82 and discard the third strap 84. In the tightened position (FIG. 18), the second end portions 46 of the first and second straps 80, 82 will be disposed within the region corresponding to the sterile zone 40 of the wearer such that the wearer can uncouple the third strap 84 without their hands being removed from the region corresponding to the sterile zone 40. Moreover, by using this configuration of surgical garment 20 along with the disclosed method of adjusting the surgical garment 20, the wearer can adjust the surgical gown 20 without the help of an additional person and without the hands of the wearer leaving the region corresponding to the sterile zone 40.

Figure 26:
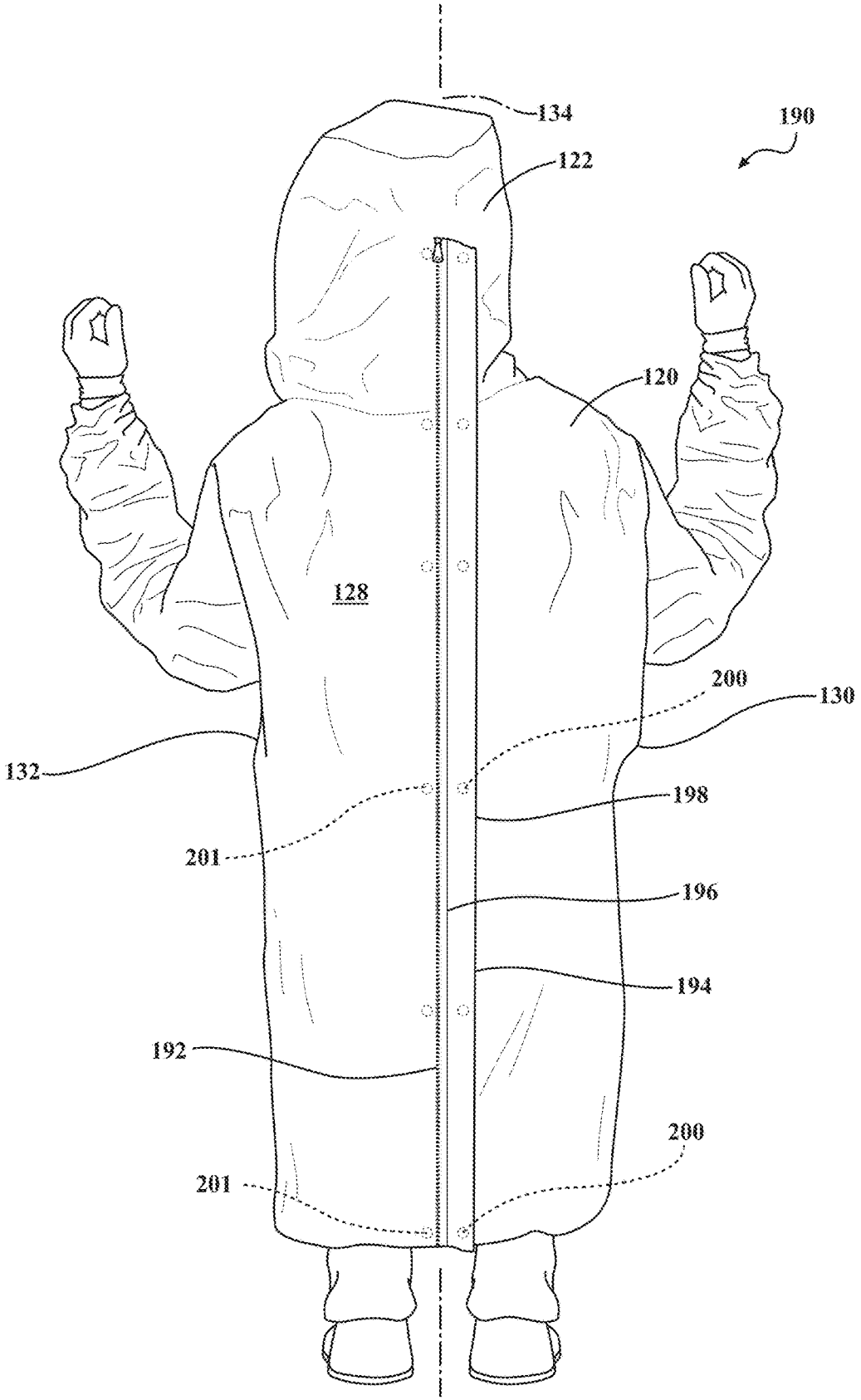
FIG. 26 is a rear perspective view of a surgical garment having a closing mechanism and a flap in an open position.
Figure 27:
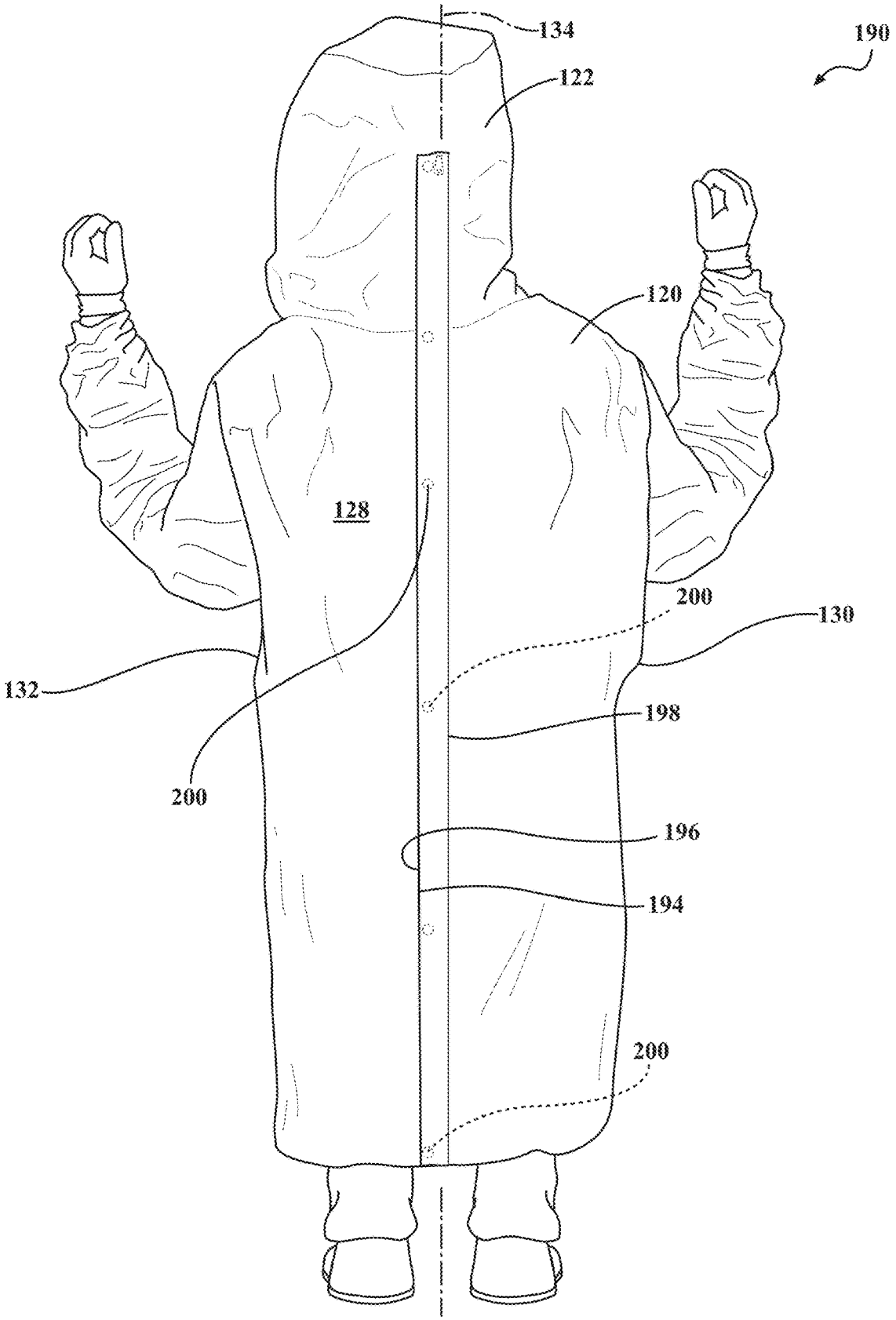
FIG. 27 is a rear perspective view of the surgical garment of FIG. 26 having the flap in a closed position.

Referring now to the example illustrated in FIGS. 26 and 27, a surgical garment 190 is disclosed. The surgical garment 190 illustrated in FIGS. 26 and 27 may include any or all of the features as described above with respect to the surgical garment 190 illustrated in FIGS. 1-25 and described herein, including but not limited to the strap 42 and/or fastening portions 48. In the example illustrated in FIGS. 26 and 27, the surgical garment 190 includes a front 124, a back 128 defining a rear mid-line 134 and two sides 130, 132 connecting the front 124 and the back 128. The front 124, back 128, and two sides 130, 132 form a microbial barrier to the wearer. Moreover, the surgical garment 190 includes a closing mechanism 192 disposed therethrough such that the surgical garment 190 may open for ease of donning. More specifically, the closing mechanism 192 is configured to be moved between an open position, where the back 128 of the surgical garment 190 is open, and a closed position, where the back 128 of the surgical garment 190 is closed. The closing mechanism 192 may be disposed along the rear mid-line 134, or may be disposed off-center of the rear mid-line 134 such that the closing mechanism 192 may be disposed elsewhere on the back 128 of the surgical garment 190. It is also contemplated that the closing mechanism 192 may be disposed on the front 124 of the surgical garment 190, if desired. In one example, illustrated in FIG. 26, the closing mechanism 192 is a zipper. More specifically, in the example illustrated in FIG. 6, the zipper is a waterproof zipper such as a reverse-coil zipper. However, it is also contemplated that the closing mechanism 192 may be any other mechanism configured to close a garment, including but not limited to a zipper of any type, snaps, buttons, hooks and loops, and other fasteners.

Referring still to FIGS. 26 and 27, the surgical garment 190 also includes a flap 194 extending over the closing mechanism 192. The flap 194 may be comprised of the same material as the remainder of the surgical garment 190, such as the tightly woven material as described above. It is also contemplated that the flap 194 may include additional waterproof barriers or coatings and/or be made of a different material configured to provide a microbial barrier to a wearer. Moreover, it is contemplated that the flap 194 may have a thickness similar to the thickness of the remainder of the surgical garment 190. However, it is also contemplated that the flap 194 may have a larger or smaller thickness to provide an additional liquid barrier.

In the example illustrated in FIGS. 26 and 27, the flap 194 is generally rectangular and has a length equal to a length of the surgical gown such that the flap 194 is configured to extend over the entire length of the closing mechanism 192. It is also contemplated that the flap 194 may have a shorter length such that a portion of the closing mechanism 192 may be exposed on the outside of the surgical garment 190 below the sterile zone, if desired. Moreover, the flap 194 has a width which is at least as wide as the closing mechanism 192. In the example illustrated in FIGS. 26 and 27, the flap 194 includes a first edge 196 and a second edge 198. The first edge 196 is secured to the back 128 of the gown adjacent to the closing mechanism 192. The first edge 196 may be secured to the surgical gown by any method including but not limited to stitching or gluing. The second edge 198 is configured to extend to the opposite side of the closing mechanism 192 such that the flap 194 extends over the closing mechanism 192. Additionally, it is contemplated that the flap 194 may have a consistent thickness, length, and/or width, or one or more of the thickness, length, or width of the flap 194 may be variable, if desired.

Referring still to the example illustrated in FIGS. 26 and 27, the surgical garment 190 also includes at least one magnetic element 200 adjacent the rear mid-line 134 and configured to secure the flap 194 over the closing mechanism 192 to provide a microbial barrier to the closing mechanism 192. In one example, the magnetic element 200 is a permanent magnet configured to produce a magnetic field. Moreover, as best shown in FIG. 26, at least one magnetic element 200 may be a first magnetic element which is enclosed within the flap 194. In the example shown in FIG. 26, five magnetic elements 200 are enclosed within the flap 194. However, more or less than five magnetic elements 200 may be enclosed within the flap 194. The magnetic elements 200 may be centrally enclosed within the flap 194 with respect to the width of the flap 194, or may be disposed closer to the first edge 196 or to the second edge 198. Moreover, the magnetic elements 200 may be evenly distributed along the length of the flap 194 or may be concentrated in one or more portions along the flap 194. It is also contemplated that the magnetic element 200 is not enclosed within the flap 194 but is otherwise attached to the flap 194, for example by gluing, and still configured to secure the flap 194 over the closing mechanism 192.

Additionally, at least one magnetic element 200 may be a second magnetic element which is enclosed within the back 128 of the surgical garment 190. The second magnetic element 201 is disposed adjacent the closing mechanism 192 on the opposite side of the closing mechanism 192 from the first edge 196 of the flap 194. In the example shown in FIG. 26, five second magnetic elements 201 are enclosed within the back 128. However, more or less than five second magnetic elements 201 may be enclosed within the back 128. It is also contemplated that the second magnetic element 201 may not be enclosed within the back 128 but is otherwise attached to the back 128, for example by gluing. Moreover, the second magnetic element 201 coupled to the back 128 of the surgical garment 190 is configured to be coupled with the first magnetic element 200 coupled to the flap 194 of the surgical garment 190 such that the first magnetic element 200 coupled to the flap 194 of the surgical garment 190 and the second magnetic element 201 coupled to the back 128 of the surgical garment 190 have opposite polarities. Additionally, one magnetic element 200 in the flap 194 is configured to be coupled to one second magnetic element 201 in the back 128 such that the back 128 and the flap 194 each contain the same number of magnetic elements 200.

In another example, the surgical garment 190 includes a ferrous element 202 configured to be coupled to the at least one magnetic element 200 to secure the flap 194 over the closing mechanism 192 to provide a microbial barrier to the closing mechanism 192. In one example, the ferrous element 202 replaces the magnetic element 200 in the back 128 of the surgical garment 190 such that the ferrous element 202 is enclosed within, or otherwise attached to, the back 128 of the surgical garment 190. In this example, the ferrous element 202 in the back 128 of the surgical garment 190 is configured to be coupled to the magnetic element 200 in the flap 194 to secure the flap 194 over the closing mechanism 192 to provide a microbial barrier to the closing mechanism 192. In yet another example, the ferrous element 202 replaces the magnetic element 200 in the flap 194 of the surgical garment 190 such that the ferrous element 202 is enclosed within, or otherwise attached to, the flap 194 of the surgical garment 190. In this example, the ferrous element 202 in the flap 194 of the surgical garment 190 is configured to be coupled to the magnetic element 200 in the back 128 of the surgical garment 190 to secure the flap 194 over the closing mechanism 192 to provide a microbial barrier to the closing mechanism 192. The ferrous elements 202 may be similar to the magnetic elements 200 as described above with respect to placement within the flap 194 or back 128 and in amount. For example, one magnetic element 200 is configured to be coupled to one ferrous element 202 such that the back 128 and the flap 194 include the same number of magnetic elements 200 and ferrous elements 202.

Referring still to the example shown in FIGS. 26 and 27, in operation, the wearer first dons the surgical garment 190. Then, the closing mechanism 192 is actuated such that the closing mechanism 192 is in the closed position (FIG. 26). Finally, as illustrated in FIG. 27, the flap 194 is secured over the closing mechanism 192 using the magnetic element 200 to provide a microbial barrier to the closing mechanism 192. More specifically, the flap 194 is secured over the closing mechanism 192 by coupling the magnetic element 200 or the ferrous element 202 located in the flap 194 with the magnetic element 200 or the ferrous element 202 located in the back 128 of the surgical garment 190. When the flap 194 is secured over the closing mechanism 192, the flap 194 provides a microbial barrier to the closing mechanism 192 which prevents liquid from entering the surgical garment 190 through the closing mechanism 192.

Also, while the protective apparel system is generally intended to provide a barrier between the medical practitioner and the patient during a medical or surgical procedure, its use is not so limited. It is within the scope of this disclosure that the garment may be used in other endeavors in which it is desirable to provide a barrier between an individual and the surrounding environment. One alternative endeavor in which it may be so desirable to use the garment is one in which it is desirable to provide a barrier between the individual and hazardous material in the environment in which the individual is working.

Several examples have been discussed in the foregoing description. However, the examples discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A sterile self-adjustable surgical garment in a sterile package comprising:

a front;

a back defining a rear mid-line;

two sides connecting said front and said back;

a first and second strap each having a first end portion, a second end portion opposite said first end portion, and a fastening portion, said first and second strap each attached at said respective first end portion to said back; and a third strap removably coupled to said first strap and said second strap;

wherein said first and second straps are configured to be at least partially disposed outside a region corresponding to a sterile zone of a wearer and said third strap is configured to be disposed at least partially within said region corresponding to the sterile zone of the wearer.

2. The sterile self-adjustable surgical garment of claim 1, wherein said first and second straps are configured to be moved between a starting position wherein said fastening portion is removably coupled to said side and a tightened position wherein said fastening portion is removably coupled to said front.

3. The sterile self-adjustable surgical garment of claim 1, wherein said third strap comprises an additional fastening portion for coupling with said second end portions of said first and second straps.

4. The sterile self-adjustable surgical garment of claim 1, wherein said back further comprises a zipper disposed along said rear mid-line.

5. The sterile self-adjustable surgical garment of claim 1, wherein said first and second straps are attached on opposite sides of said rear mid-line.

6. The sterile self-adjustable surgical garment of claim 1, wherein the fastening portion of each of said first and second straps comprises a removable coupling device including hooks that are configured to removably couple to a portion of the surgical garment.

7. The sterile self-adjustable surgical garment of claim 1, wherein the fastening portion of each of said first and second straps comprises a removable coupling device including hooks; and wherein a portion of the surgical garment includes loops configured to removably couple to the hooks of the removable coupling device.

8. The sterile self-adjustable surgical garment of claim 1, wherein at least one of said first strap or said second strap comprises an elastic material.

9. A method of securing a self-adjustable surgical garment, the self-adjustable surgical garment including a front, a back, two sides connecting the front and the back, a first and second strap each having a first end portion, a second end portion opposite the first end portion, and a fastening portion, the first and second strap each attached at the first end portion to the back; and a third strap removably coupled to the first strap and the second strap, said method comprising:

donning the self-adjustable surgical garment onto a wearer such that the first and second straps are at least partially disposed outside a region corresponding to a sterile zone of the wearer and the third strap is at least partially disposed within the region corresponding to the sterile zone of the wearer; and moving the first and second straps from a starting position where the fastening portion is coupled to the back or the sides of the garment to a tightened position where the fastening portion is coupled to the front of the garment without hands of the wearer exiting the region corresponding to the sterile zone of the wearer.

10. The method of claim 9, further comprising the step of separating the third strap from the first and second straps such that the third strap is removed from the garment.

11. The method of claim 9, wherein the step of moving the first and second straps from the starting position to the tightened position is further defined as engaging the third strap to uncouple the fastening portions of the first and second straps from the back or side of the garment and moving the third strap within the region corresponding to the sterile zone of the wearer such that the fastening portion of the first and second straps is moved within the region corresponding to the sterile zone to be coupled with the front of the garment.

12. The method of claim 9, wherein the step of donning the self-adjustable surgical garment onto a wearer further comprises closing a zipper disposed along a rear mid-line of said back.

13. The method of claim 9, wherein the fastening portion of the first and second straps comprises a removable coupling device including hooks that are configured to removably couple to a portion of the surgical garment.

14. The method of claim 9, wherein the fastening portion of the first and second straps comprises a removable coupling device including hooks; and wherein a portion of the surgical garment includes loops configured to removably couple to the hooks of the removable coupling device.

15. A sterile self-adjustable surgical garment in a sterile package comprising:

a front;

a back defining a rear mid-line;

two sides connecting said front and said back;

a first and second strap each having a first end portion, a second end portion opposite said first end portion, and a fastening portion, said first and second strap each attached at said respective first end portion to said back; and a third strap having opposed ends, each of the opposed ends removably coupled to one of the first end portions of each of said first strap and said second strap via the fastening portion;

wherein said first and second straps are configured to be at least partially disposed outside a region corresponding to a sterile zone of a wearer and said third strap is configured to be disposed at least partially within said region corresponding to the sterile zone of the wearer.

16. The sterile self-adjustable surgical garment of claim 15, wherein the fastening portion of each of said first and second straps comprises a removable coupling device including hooks that are configured to removably couple to a portion of the surgical garment.

17. The sterile self-adjustable surgical garment of claim 15, wherein the fastening portion of each of said first and second straps comprises a removable coupling device including hooks; and wherein a portion of the surgical garment includes loops configured to removably couple to the hooks of the removable coupling device.

18. The sterile self-adjustable surgical garment of claim 15, wherein said back further comprises a zipper disposed along said rear mid-line.

19. The sterile self-adjustable surgical garment of claim 15, wherein said first and second straps are attached on opposite sides of said rear mid-line.

20. The sterile self-adjustable surgical garment of claim 15, wherein said first and second straps are configured to be moved between a starting position wherein said fastening portion is removably coupled to said side and a tightened position wherein said fastening portion is removably coupled to said front.

* * * * *